US007334559B2

(12) United States Patent
Osanai

(10) Patent No.: US 7,334,559 B2
(45) Date of Patent: Feb. 26, 2008

(54) EVAPORATIVE FUEL SUPPLY APPARATUS

(75) Inventor: Akinori Osanai, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 11/181,933

(22) Filed: Jul. 15, 2005

(65) Prior Publication Data

US 2006/0037588 A1 Feb. 23, 2006

(30) Foreign Application Priority Data

Aug. 23, 2004 (JP) ..... 2004-242835

(51) Int. Cl.
*F02M 33/02* (2006.01)
*F02M 17/30* (2006.01)

(52) U.S. Cl. ..... 123/198 D; 123/520

(58) Field of Classification Search ..... 123/520, 123/198 D, 518, 519, 516
See application file for complete search history.

(56) References Cited

U.S. PATENT DOCUMENTS 1,875,024 A * 8/1932 Kryzanowsky ..... 422/107
3,158,142 A * 11/1964 Bradshaw ..... 123/572
4,991,559 A * 2/1991 Osawa et al. ..... 123/682
5,245,975 A * 9/1993 Ito ..... 123/520
6,095,121 A * 8/2000 Osanai ..... 123/520
6,401,684 B2 * 6/2002 Hori et al. ..... 123/198 F
6,739,320 B2 * 5/2004 Ito et al. ..... 123/674
7,124,749 B2 * 10/2006 Ohhashi et al. ..... 123/520
2001/0003979 A1 * 6/2001 Oki et al. ..... 123/520

FOREIGN PATENT DOCUMENTS

JP A 03-37270 4/1991
JP A 07-229452 8/1995
JP A 2002-021643 1/2002

* cited by examiner

*Primary Examiner*—Carl S. Miller
(74) *Attorney, Agent, or Firm*—Oliff & Berridge, PLC

(57) ABSTRACT

A canister is furnished to store evaporative fuel. A purge line is furnished to ensure that the canister communicates with an internal combustion engine intake path. The purge line is provided with a D-VSV (purge control valve) that controls the continuity of the purge line. Further, a check valve is furnished to control the pressure propagation from the intake path to the canister at the time of backfiring.

12 Claims, 18 Drawing Sheets

EVAPORATIVE FUEL SUPPLY APPARATUS

BACKGROUND OF THE INVENTION

1. Field of the Invention

The present invention relates to an evaporative fuel supply apparatus, and more particularly to an evaporative fuel supply apparatus that is suitable for supplying evaporative fuel to an internal combustion engine intake system when an internal combustion engine is to be cold-started.

2. Background Art

A conventionally known system disclosed, for instance, by Japanese Patent Laid-Open No. Hei7-229452 stores evaporative fuel, which is generated within a fuel tank, in a canister, and supplies the stored fuel to an intake path during an internal combustion engine operation. When the evaporative fuel is supplied to the intake path, the air-fuel ratio is likely to become disordered. Therefore, the evaporative fuel is generally supplied after internal combustion engine warm-up.

When the temperature is low, liquid fuel is not likely to vaporize. Therefore, the supply of already evaporative fuel to the internal combustion engine is effective for fuel combustibility enhancement. Under these circumstances, the startability of the internal combustion engine can be improved by supplying evaporative fuel to the intake system when the internal combustion engine is to be cold-started.

Under the above circumstances, however, the amount of fuel supply to the internal combustion engine is insufficient so that cylinder combustion may not properly take place during an explosion stroke. Consequently, the intake stroke may begin before completion of cylinder gas combustion. In such a situation, combustion may propagate to the air-fuel mixture existing in the intake path at the beginning of the intake stroke so that backfiring occurs.

The conventional system described above does not assume that evaporative fuel is supplied to the internal combustion engine when it is to be cold-started. Therefore, the conventional system does not assume that backfire may be generated. Consequently, no provision is made in the conventional system in consideration of the influence of backfire.

Including the above-mentioned document, the applicant is aware of the following documents as a related art of the present invention.

[Patent Document 1] Japanese Patent Laid-Open No. Hei7-229452

[Patent Document 2] Japanese Utility Model Laid-open No. Hei3-37270

[Patent Document 3] Japanese Patent Laid-Open No. 2002-21643

However, when backfire occurs, an abnormal pressure arises within the intake path. In the above conventional system, the abnormal pressure propagates to the canister via evaporative fuel supply piping. This pressure propagation decreases the durability of the canister. In this respect, the above conventional system is not always an optimum apparatus for supplying evaporative fuel to the intake system at a cold start.

SUMMARY OF THE INVENTION

The present invention has been made to solve the above problem. It is an object of the present invention to provide an evaporative fuel supply apparatus that will not be unduly damaged even when backfire occurs.

The above object is achieved by an evaporative fuel supply apparatus. The apparatus includes a canister for storing evaporative fuel. The apparatus also includes a purge line for allowing the canister to communicate with an internal combustion engine intake path. The apparatus further includes a purge control valve installed in the purge line. The apparatus further includes a pressure propagation suppression device for suppressing the pressure propagation from the intake path to the canister at the time of backfiring.

Other objects and further features of the present invention will be apparent from the following detailed description when read in conjunction with the accompanying drawings.

BEST MODE FOR CARRYING OUT THE INVENTION

First Embodiment

Configuration of First Embodiment

Figure 1:
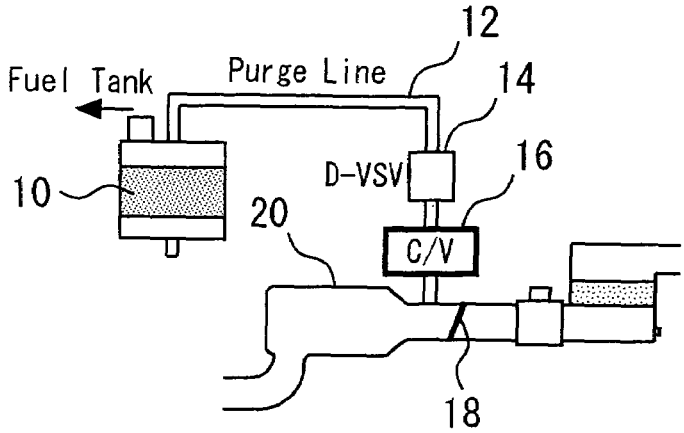
FIG. 1 illustrates a configuration of an evaporative fuel supply apparatus according to a first embodiment of the present invention.

FIG. 1 illustrates the configuration of an evaporative fuel supply apparatus according to a first embodiment of the present invention. As shown in FIG. 1, the apparatus according to the present embodiment includes a canister 10. The canister 10 communicates with a fuel tank (not shown). Evaporative fuel generated in the fuel tank can be stored in the canister 10.

The canister 10 communicates with a purge line 12. The purge line 12 incorporates a D-VSV 14 and a check valve 16. The end of the purge line 12 communicates with an internal combustion engine intake path 20 on the downstream side of a throttle valve 18. The D-VSV 14 is a control valve that receives a duty signal and repeatedly opens/closes at a duty ratio designated by the duty signal. In a system shown in FIG. 1, the rate of purge gas flow into the intake path 20 via the purge line 12 can be controlled by subjecting the D-VSV 14 to proper duty cycle drive while an intake negative pressure is generated.

The check valve 16 is a one-way valve that permits fluid to flow merely from the canister 10 to the intake path 20. The check valve 16 permits evaporative fuel to flow from the purge line 12 to the intake path 20, but stops a fluid flow or pressure propagation from the intake path 20 to the canister 10.

Operation Specific to First Embodiment

The apparatus according to the present embodiment permits evaporative fuel, which is generated in the fuel tank during an internal combustion engine operation or supplied from the fuel tank during fueling, to be stored in the canister 10. Further, when the internal combustion engine is to be cold-started, the apparatus can properly open the D-VSV 14 to supply the evaporative fuel in the canister 10 to the intake path 20, thereby obtaining a desired air-fuel ratio.

The opening of the D-VSV 14 is controlled by a known method so that the rate of evaporative fuel flow into the intake path 20 provides a desired air-fuel ratio. When such a control method is used, the fuel required for an internal combustion engine operation can be supplied to each cylinder in vapor form at the time of internal combustion engine cold startup.

If the internal combustion engine is cold-started, liquid fuel is not likely to vaporize. Therefore, when evaporative fuel is supplied to the internal combustion engine, the resulting combustibility is better than when liquid fuel is supplied. Thus, the apparatus according to the present embodiment can sufficiently improve the cold startability of the internal combustion engine.

If an attempt is made to supply fuel at the time of cold startup mainly by using evaporative fuel, the resulting amount of fuel supply may be insufficient. When the amount of supplied fuel is insufficient, proper combustion may not take place during the explosion stroke so that cylinder combustion is delayed. Such a delay in combustion permits a high-temperature, high-pressure gas to remain in a cylinder until the exhaust stroke ends, that is, until the intake stroke begins. In this instance, a fresh gas existing in the intake path catches fire to generate backfire the moment the intake valve opens to initiate the intake stroke.

When backfire occurs, the internal pressure within the intake path 20 unduly rises for a temporary period of time. When the resulting high pressure propagates to the canister 10 via the purge line 12, the canister 10 may suffer some damage. However, the apparatus according to the present embodiment uses the check valve 16 to control, more strictly, avoid the abnormal pressure propagation, which is caused by the occurrence of backfire. Consequently, the apparatus according to the present embodiment properly prevents the canister 10 from suffering some damage due to the occurrence of backfire. In this respect, the apparatus according to the present embodiment is particularly suitable for supplying fuel mainly in vapor form at the time of cold startup.

Features of the Check Valve of First Embodiment

Figure 2:
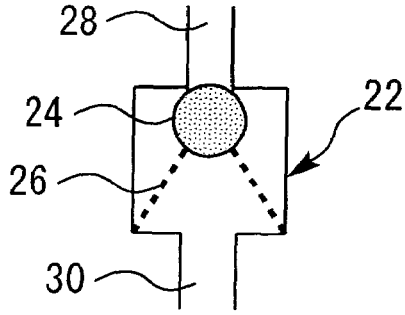
FIG. 2 illustrates a structure of a common check valve.
Figure 3A:
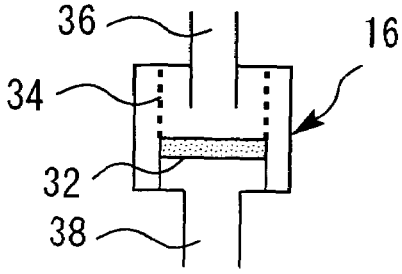
FIGS. 3A and 3B illustrate a configuration and operation of a check valve for use in the first embodiment of the present invention.
Figure 3B:
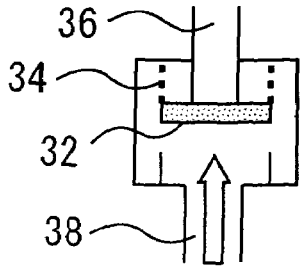

FIG. 2 illustrates the structure of a common check valve 22. FIGS. 3A and 3B illustrate the configuration and operation of the check valve 16 for use in the present embodiment.

The check valve 22 shown in FIG. 2 includes a ball valve 24 and a spring 26. The spring 26 presses the ball valve 24 toward an inflow port 28. When the pressure on the inflow port 28 is higher than the pressure on an outflow port 30 during the use of the check valve 22, the flow of fluid can be permitted by opening the ball valve 24. If, on the other hand, the pressure on the outflow port 30 is higher than the pressure on the inflow port 28, the ball valve 24 closes to stop the pressure propagation.

The abnormal pressure propagation, which may be caused by backfire, can also be stopped by incorporating the check valve 22 shown in FIG. 2 into the purge line 12. However, the structure of the check valve 22 cannot prevent a certain flow resistance from being generated in order to invoke a forward flow. Such a flow resistance is not favorable in a situation where evaporative fuel needs to flow into the intake path 20 at an adequate flow rate.

FIG. 3A shows a normal state of the check valve 16 for use in the present embodiment. As indicated in the figure, the check valve 16 includes a valve disc 32 and a spring 34. When pressed by the spring 34, the valve disc 32 is maintained at a position at which the inflow port 36 and outflow port 38 communicate with each other during a normal state. Therefore, the check valve 16 permits a forward flow, that is, a flow from the inflow port 36 to the outflow port 38 without giving rise to any flow resistance.

FIG. 3B shows a state of the check valve 16 that prevails when the pressure on the outflow port 38 is higher than the pressure on the inflow port 36, that is, when a reverse pressure is exerted on the valve disc 32. When a reverse pressure is applied, the valve disc 32 moves to a valve closing position as indicated in the figure so that the outflow port 38 is isolated from the inflow port 36. Therefore, when backfire occurs, the check valve 16 properly stops the pressure propagation from the intake path 20 to the canister 10.

As described above, the check valve 16 shown in FIGS. 3A and 3B properly stops the reverse pressure propagation without incurring any virtual forward flow resistance. Therefore, the apparatus according to the present embodiment is capable of implementing a function for providing a large evaporative fuel flow rate and a function for stopping the backfire-induced abnormal pressure propagation.

Second Embodiment

Figure 4A:
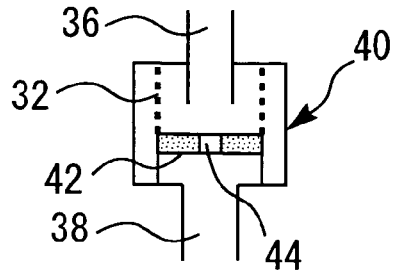
FIGS. 4A and 4B illustrate a configuration and operation of a check valve for use in a second embodiment of the present invention.
Figure 4B:
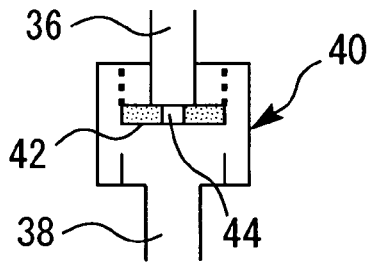

A second embodiment of the present invention will now be described with reference to FIGS. 4A and 4B. FIGS. 4A and 4B illustrate the configuration and operation of a check valve 40 for use in the present embodiment. The apparatus according to the present embodiment is the same as the apparatus according to the first embodiment except that check valve 40 is used instead of check valve 16.

FIG. 4A illustrates a normal state of the check valve 40. FIG. 4B illustrates a state of the check valve 40 that prevails when a reverse pressure is exerted. When the present embodiment is described with reference to FIGS. 4A and 4B, elements identical with those described with reference to FIGS. 3A and 3B are designated by the same reference numerals as their counterparts and omitted from the description.

As indicated in FIGS. 4A and 4B, the check valve 40 includes a valve disc 42. The valve disc 42 is provided with an orifice 44. The orifice 44 ensures that the space toward the inflow port 36 and the space toward the outflow port 38 constantly communicate with each other. Therefore, even when the valve disc 42 is closed, the check valve 40 ensures that the pressure on the outflow port 38 is slightly released toward the inflow port 36.

In other words, even when backfire occurs in the internal combustion engine so that the check valve 40 is closed, the apparatus according to the present embodiment ensures that the pressure on the intake path 20 is slightly released toward the canister 10. In this instance, it is possible to prevent the pressure within the intake path 20 from unduly rising at the time of backfire generation while preventing an unduly high pressure, which results from backfire generation, from affecting the canister 10. As a result, the apparatus according to the present embodiment effectively protects both the canister 10 and intake path 20 at the time of backfire generation.

Third Embodiment

Configuration of Third Embodiment

A third embodiment of the present invention will now be described with references to FIGS. 5 to 8.

Figure 5:
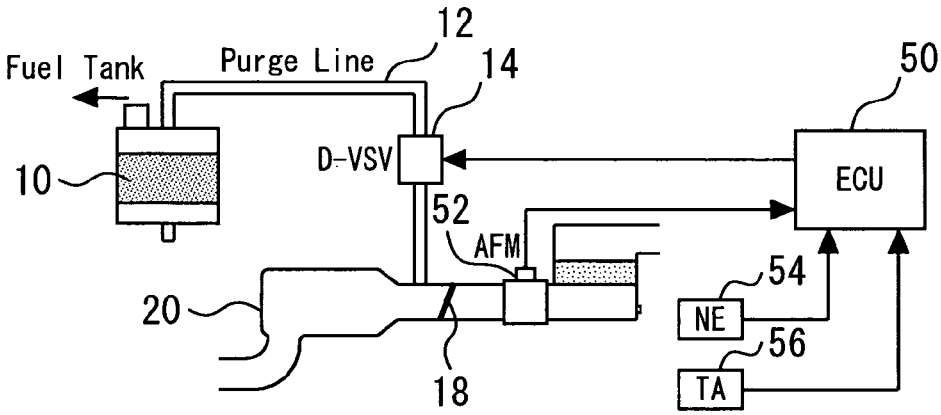
FIG. 5 illustrates a configuration of an evaporative fuel supply apparatus according to a third embodiment of the present invention.

FIG. 5 illustrates the configuration of an evaporative fuel supply apparatus according to the third embodiment of the present invention. When the present embodiment is described with reference to FIG. 5, elements identical with those described with reference to FIG. 1 are designated by the same reference numerals as their counterparts and omitted from the description or briefly described.

In the apparatus according to the present embodiment, the D-VSV 14 directly communicates with the intake path 20 without via the check valve 16. Further, the apparatus according to the present embodiment includes an ECU (Electronic Control Unit) 50. The ECU 50 is connected to the D-VSV 14 and an air flow meter 52. The air flow meter 52 is a sensor that is positioned upstream of the throttle valve 18 to detect an intake air amount GA of the internal combustion engine.

The ECU 50 is also connected to a rotation speed sensor 54 and a throttle sensor 56. The rotation speed sensor 54 detects an engine speed NE. The throttle sensor 56 detects the degree of opening of the throttle valve 18.

Description of Combustion Pressure Variation due to Backfire Generation

As is the case with the apparatus according to the first embodiment, the apparatus according to the present embodiment properly opens the D-VSV 14 to supply evaporative fuel to the intake path 20 and obtain a desired air-fuel ratio when the internal combustion engine is to be cold started. For the apparatus according to the present embodiment, therefore, it is necessary to assume that backfire occurs during evaporative fuel supply. This also holds true for all the embodiments described later.

Figure 6:
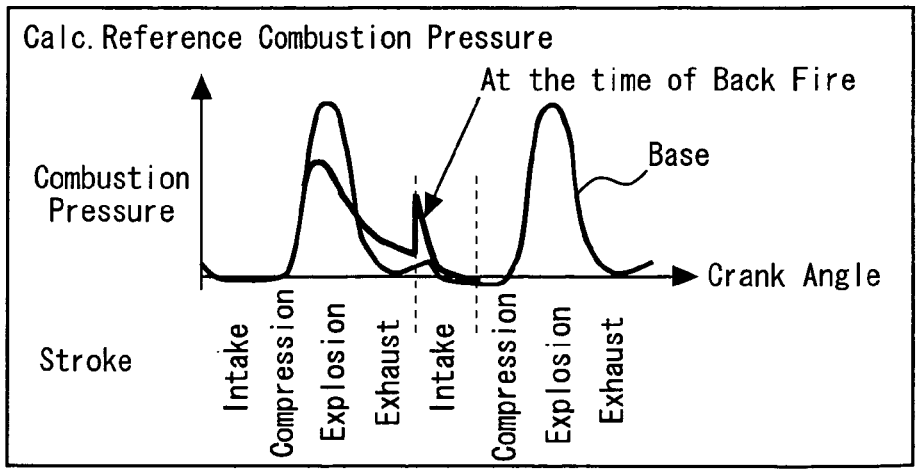
FIG. 6 compares the cylinder pressure (thin line) prevailing in a normal state and the cylinder pressure (thick line) prevailing when backfire occurs.

FIG. 6 compares the cylinder pressure (thin line) prevailing in a normal state and the cylinder pressure (thick line) prevailing when backfire occurs. When combustion normally takes place in a cylinder, the combustion is completed within a short period of time. Therefore, the cylinder pressure (thin line) prevailing in a normal state suddenly increases during the explosion stroke, and then decreases to a level near the atmospheric pressure during the exhaust stroke as indicated in FIG. 6.

As described earlier, backfire occurs when the combustion during the explosion stroke is improper due to an insufficient amount of fuel supply to a cylinder. In other words, backfire occurs when, as indicated by the thick line, the combustion pressure does not suddenly rise during the explosion stroke and cylinder gas combustion continues at the end of the exhaust stroke (that is, when a high-temperature, high-pressure gas remains in a cylinder). In this instance, when the intake valve opens at the beginning of the intake stroke, a fresh gas existing in the intake path comes into contact with the high-temperature, high-pressure gas in the cylinder and burns. As a result, backfire occurs. In this instance, the cylinder pressure and the pressure within the intake path 20 become unduly high for a temporary period of time due to fresh gas combustion.

When the pressure within the intake path 20 increases the moment the intake valve opens, the intake air flow is obstructed so that the intake air amount GA decreases. Therefore, when the intake air amount GA detected by the air flow meter 52 is constantly monitored and found to be smaller than a predefined value, it can be estimated that backfire is generated. More specifically, when the intake air amount GA is sufficiently smaller than the predefined value, it can be judged that the pressure PM within the intake path 20 is increased due to backfiring.

The apparatus according to the present embodiment uses the above method for detecting the occurrence of backfire. When the occurrence of backfire is detected, the apparatus according to the present embodiment keeps the D-VSV 14 closed until an abnormal pressure vanishes from the intake path 20. When this process is performed, it is possible to prevent the abnormal pressure generated within the intake path 20 from propagating to the canister 10 and protect the canister 10 from the influence of backfiring.

Details of Process Performed by Third Embodiment

Figure 7:
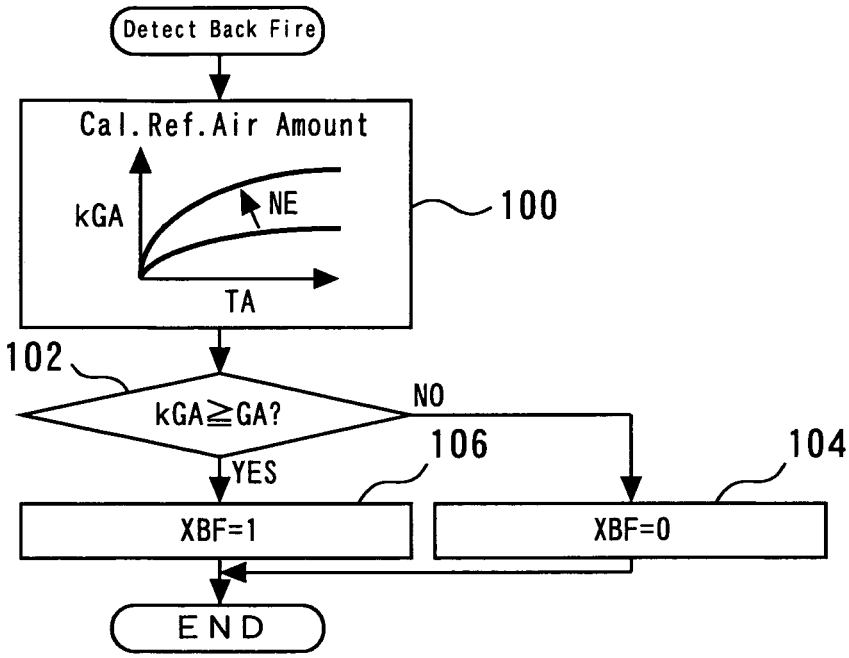
FIG. 7 is a flowchart illustrating a routine executed to detect a occurrence of backfire in the evaporative fuel supply apparatus according to the third embodiment of the present invention.

FIG. 7 is a flowchart illustrating a routine that the ECU 50 executes to detect the occurrence of backfire by the above method. The routine shown in FIG. 7 is repeatedly executed at 4 msec or other sufficiently short intervals.

In the routine shown in FIG. 7, step 100 is first performed to calculate a reference air amount kGA in accordance with the current operation status. The intake air amount GA for the internal combustion engine is determined roughly in accordance with the engine speed NE and throttle opening TA. The ECU 50 stores a map that defines the relationship among the intake air amount GA, engine speed NE, and throttle opening TA. More specifically, the map defines the relationship of the maximum intake air amount Ga that is to be recognized as an abnormal value, after considering the influence, for instance, of intake pulsation to the engine speed NE and throttle opening TA. In step 100, the map is referenced to calculate the reference air amount kGA for the current engine speed NE and throttle opening TA.

Next, step 102 is performed to judge whether the intake air amount GA measured by the air flow meter 52 is smaller than the reference air amount kGA. If the obtained judgment result does not indicate that kGA≦GA, it can be concluded that the generated intake air amount GA is normal. In this instance, it can also be concluded that no backfire is generated in the internal combustion engine. In this case, a backfire flag XBF is subsequently set to 0 to indicate that no backfire is generated (step 104).

If, on the other hand, the judgment result obtained in Step 102 indicates that kGA≦GA, it can be concluded that the intake air amount GA is unduly small. In this instance, it is concluded that backfire is generated, and the backfire flag XBF is set to 1 (step 106).

When the intake air amount GA is unduly decreased due to the occurrence of backfire, the above process sets the backfire flag XBF to 1. In other words, when the intake valve opens to incur backfiring, the above process sets the backfire flag XBF to 1 at an early stage of backfire occurrence.

Figure 8:
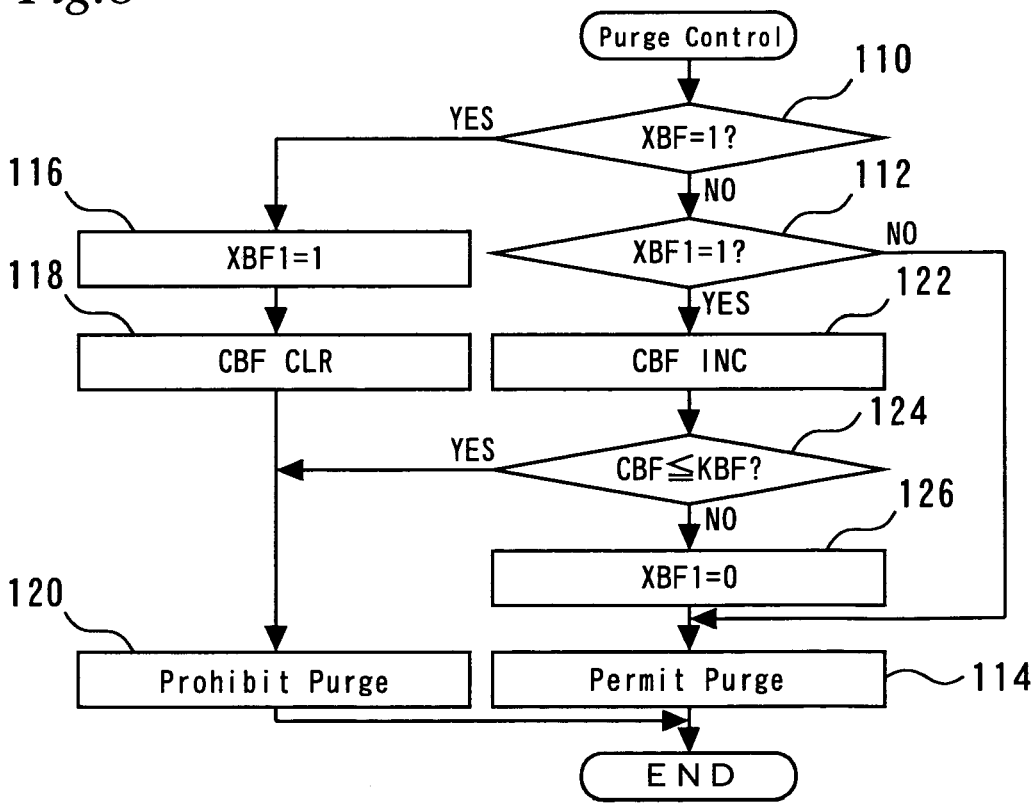
FIG. 8 is a flowchart illustrating a routine executed to protect a canister by closing a D-VSV in the event of backfiring in the evaporative fuel supply apparatus according to the third embodiment of the present invention.

FIG. 8 is a flowchart illustrating a routine that the ECU 50 executes to protect the canister 10 by closing the D-VSV 14 in the event of backfiring. As is the case with the routine shown in FIG. 7, the routine shown in FIG. 8 is repeatedly executed at fixed time intervals.

In the routine shown in FIG. 8, step 110 is first performed to judge whether the backfire flag XBF is set to 1. If the occurrence of backfire is not recognized, the backfire flag XBF is set to 0. In this instance, the query in step 110 is answered "NO."

If the query in step 110 is answered "NO," step 112 is performed to judge whether a first backfire flag XBF1 is set to 1. The first backfire flag XBF1 is initially set to 0. Therefore, when the occurrence of backfire is not recognized, the query in step 112 is answered "NO." In this instance, the current routine terminates with a purge execution permitted (step 114).

When backfire occurs so that the backfire flag XBF is set to 1, the judgment result obtained in step 110 indicates that XBF=1. In this instance, the first backfire flag XBF1 is set to 1 (step 116). Step 118 is then performed to clear a backfire counter CBF. Next, step 120 is performed to prohibit a purge execution.

While a purge execution is prohibited, the D-VSV 14 is kept closed. Therefore, while a purge execution is prohibited, the pressure propagation from the intake path 20 to the canister 10 is stopped. Thus, the above process prevents an unduly high pressure from propagating to the canister 10 after the occurrence of backfire.

When the intake air amount GA is restored to a normal value, the process shown in FIG. 7 sets the backfire flag XBF to 0 (see steps 102 and 104). When the pressure within the intake path 20 decreases to a certain degree, the intake air amount GA is restore to a normal value. Therefore, the step 110 condition (XBF=1) is not met when a short period of time elapses after the occurrence of backfire.

When it is found after the occurrence of backfire that the condition (XBF=1) is not met, step 112 is performed again for judgment. Since the first backfire flag XBF1 is set to 1 this time, it is found that the step 112 condition is met. In this instance, step 122 is performed to increment the backfire counter CBF. Next, step 124 is performed to judge whether its count CBF is not greater than a judgment value KBF.

When the above process is performed, the backfire counter CBF indicates the elapsed time after the occurrence of backfire is recognized, that is, the elapsed time after the intake valve for a cylinder in which backfire is generated opens (approximately after top dead center passage). The value reached by the backfire counter CBF before the influence of backfire vanishes, allowing the pressure and temperature prevailing within the intake path 20 to revert to normal values (more specifically, before the crank angle of a cylinder in which backfire is generated reaches approximately 30° CA after top dead center (ATDC)), is set as the judgment value KBF.

Therefore, the influence of backfire remains while the judgment result obtained in step 124 indicates that CBF≦KBF, and it can be concluded that additional backfire occurs if a purge is resumed. In this instance, the routine shown in FIG. 8 performs step 120 to continuously prohibit a purge.

If, on the other hand, the judgment result obtained in step 124 does not indicate that CBF≦KBF, it can be concluded that a purge can be resumed because the influence of backfire has vanished. In this instance, the first backfire flag XBF1 is reset to 0 (step 126), and then step 114 is performed to permit a purge execution.

When it is found that backfire is generated in a certain cylinder, the above process prohibits a purge execution while the influence of backfire remains, and resumes a purge when the influence vanishes. The above process makes it possible to effectively prevent an abnormal pressure, which is invoked by backfire generation, from propagating to the canister 10, avoid a purge execution that promotes backfire generation, and continuously supply evaporative fuel to the internal combustion engine as far as possible. Therefore, the apparatus according to the present embodiment is capable of effectively protecting the canister 10 from an abnormal pressure, which is generated upon backfiring, and continuously supplying evaporative fuel to the internal combustion engine.

The apparatus according to the first embodiment, which has been described earlier, uses the check valve 16 to eliminate the influence of backfire. In this instance, purge resumption depends on the pressure difference between one end of the check valve 16 and the other. Therefore, purge resumption may take place before combustion stabilization depending on pressure wave delay or pressure reaction. On the other hand, the apparatus according to the present embodiment can issue purge resumption instructions with an arbitrary delay after closing the D-VSV 14 upon backfire generation. Therefore, the apparatus according to the present embodiment provides an internal combustion engine operation that is stabler than provided by the apparatus according to the first embodiment.

The third embodiment, which has been described above, constantly monitors the intake air amount GA in order to detect the occurrence of backfire. However, the present invention is not limited to the use of such a detection method. Alternatively, the intake air amount GA may be monitored in synchronism with a crank angle. More specifically, the intake air amount GA may be monitored at a crank angle at which the intake valve opens for a cylinder (at a crank angle at which an abnormal pressure arises upon backfiring).

The third embodiment, which has been described above, compares an instantaneous value of the intake air amount GA against the reference air amount kGA to judge whether backfire is generated. However, the present invention is not limited to the use of such a judgment method. For example, the above judgment may alternatively be formed by comparing the average value of the intake air amount GA prevailing at approximately 30° CA before top dead center (BTDC) against the reference air amount kGA.

Fourth Embodiment

Configuration of Fourth Embodiment

A fourth embodiment of the present invention will now be described with reference to FIGS. 9 and 10.

Figure 9:
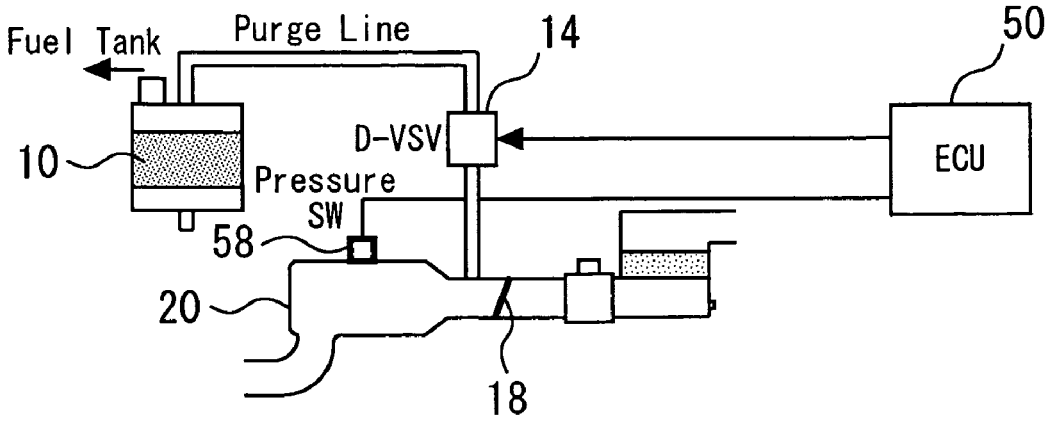
FIG. 9 illustrates a configuration of an evaporative fuel supply apparatus according to a fourth embodiment of the present invention.

FIG. 9 illustrates the configuration of the fourth embodiment of the present invention. The apparatus according to the present embodiment is implemented when the ECU 50, which is included in the configuration shown in FIG. 9, executes a routine shown in FIG. 10 together with the routine shown in FIG. 8.

The configuration shown in FIG. 9 is substantially the same as the configuration shown in FIG. 5 except that the former includes a pressure switch 58. The pressure switch 58 is positioned downstream of the throttle valve 18, or more specifically, mounted on an intake manifold (surge tank) in the intake path 20.

While the internal combustion engine is operated, the pressure PM within the intake path 20 generally remains negative. However, when backfire occurs, the pressure PM temporarily becomes positive. The pressure switch 58 for use in the present embodiment generates an ON output in response to a pressure PM that is attained only when backfire occurs. Therefore, when the configuration shown in FIG. 9 is employed, the output generated by the pressure switch 58 can be monitored to judge whether backfire is generated.

Details of Process Performed by Fourth Embodiment

Figure 10:
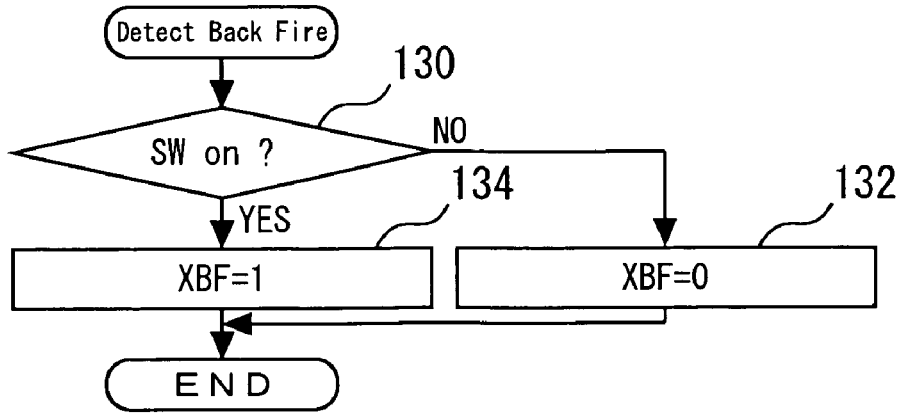
FIG. 10 is a flowchart illustrating a routine executed to detect a occurrence of backfire in the evaporative fuel supply apparatus according to the fourth embodiment.

FIG. 10 is a flowchart illustrating a routine that the ECU 50 according to the present embodiment executes to detect the occurrence of backfire. This routine is repeatedly started at 4 msec or other sufficiently short intervals.

In the routine shown in FIG. 10, step 130 is first performed to judge whether the pressure switch 58 has generated an ON output. If the obtained judgment result does not indicate that the ON output is generated, step 132 is performed to set the backfire flag XBF to 0. If, on the other hand, the obtained judgment indicates that the ON output is generated, step 134 is performed to set the backfire flag XBF to 1.

As is the case where the routine shown in FIG. 7 is executed, the above process sets the backfire flag XBF to 1 only when the pressure within the intake path 20 is unduly high due to backfiring. Therefore, when the routine shown in FIG. 8 is executed, the apparatus according to the present embodiment implements the same functionality as the apparatus according to the third embodiment.

The fourth embodiment, which has been described above, constantly monitors the status of the pressure switch 58 in order to detect the occurrence of backfire. However, the present invention is not limited to the use of such a detection method. Alternatively, the status of the pressure switch 58 may be monitored in synchronism with a crank angle. More specifically, the status of the pressure switch 58 may be monitored at a crank angle at which the intake valve opens for a cylinder (at a crank angle at which an abnormal pressure arises upon backfiring).

Fifth Embodiment

Configuration of Fifth Embodiment

A fifth embodiment of the present invention will now be described with reference to FIGS. 11 and 12.

Figure 11:
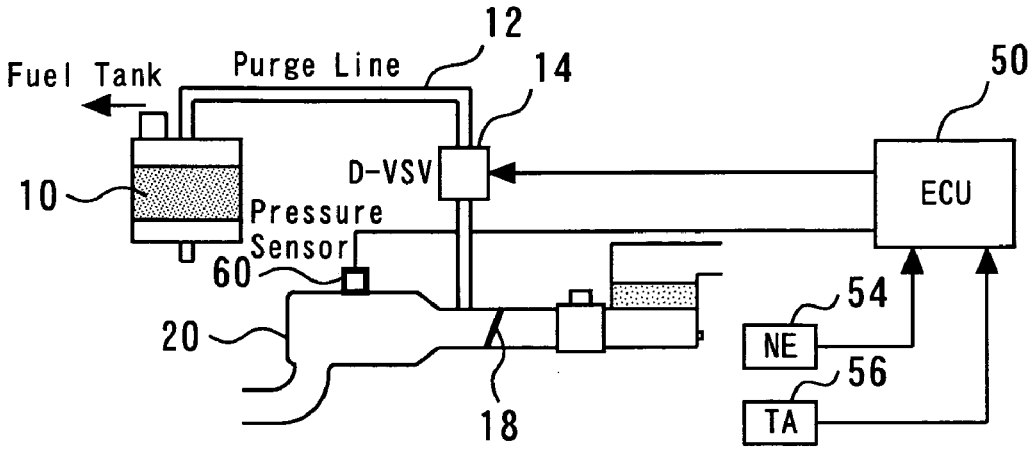
FIG. 11 illustrates a configuration of an evaporative fuel supply apparatus according to a fifth embodiment of the present invention.

FIG. 11 illustrates the configuration of the fifth embodiment of the present invention. The apparatus according to the present embodiment is implemented when the ECU 50, which is included in the configuration shown in FIG. 11, executes a routine shown in FIG. 12 together with the routine shown in FIG. 8.

The configuration shown in FIG. 11 is substantially the same as the configuration shown in FIG. 5 except that the former includes a pressure sensor 60. The pressure sensor 60 is positioned downstream of the throttle valve 18, or more specifically, mounted on an intake manifold (surge tank) in the intake path 20. The pressure sensor 60 is used to detect the pressure PM within the intake path 20.

When backfire occurs, the pressure PM within the intake path 20 is sufficiently higher than a normal level as described earlier. Therefore, when the output generated by the pressure sensor 60 is monitored, it is possible to accurately judge whether backfire has occurred.

Details of Process Performed by Fifth Embodiment

Figure 12:
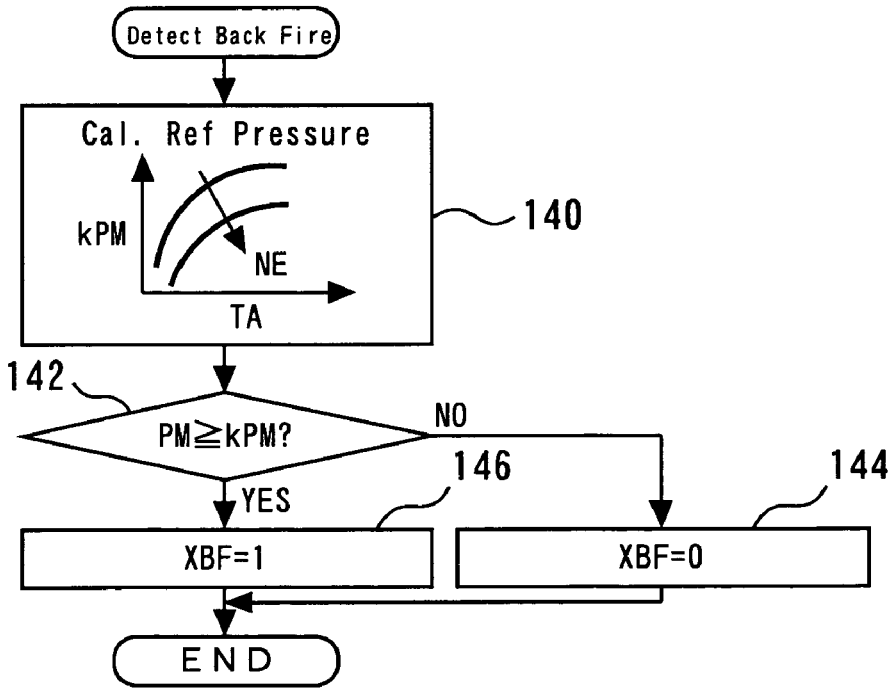
FIG. 12 is a flowchart illustrating a routine executed to detect a occurrence of backfire in the evaporative fuel supply apparatus according to the fifth embodiment of the present invention.

FIG. 12 is a flowchart illustrating a routine that the ECU 50 according to the present embodiment executes to detect the occurrence of backfire. This routine is repeatedly started at 4 msec or other sufficiently short intervals.

In the routine shown in FIG. 12, step 140 is first performed to calculate a reference pressure kPM for the current operation status. The pressure PM within the intake path 20 is determined roughly in accordance with the engine speed NE and throttle opening TA. The ECU 50 stores a map that defines the relationship among the intake path pressure PM, engine speed NE, and throttle opening TA. More specifically, the map defines the relationship of a boundary value of the intake pressure PM that is to be recognized as an abnormal value, after considering the influence, for instance, of intake pulsation to the engine speed NE and throttle opening TA. In step 140, the map is referenced to calculate the reference pressure kPM for the current engine speed NE and throttle opening TA.

Next, step 142 is performed to judge whether the intake pressure PM measured by the pressure sensor 60 is not lower than the reference pressure kPM. If the obtained judgment result does not indicate that PM≦kPM, it can be concluded that the intake pressure PM is proper. In this instance, it can also be concluded that no backfire has occurred in the internal combustion engine. In this case, the backfire flag XBF is subsequently set to 0 to indicate that no backfire is generated (step 144).

If, on the other hand, the judgment result obtained in step 142 indicates that PM≦kPM, it can be concluded that the intake pressure PM is unduly high. In this instance, it is judged that backfire has occurred, and the backfire flag XBF is set to 1 (step 146).

As is the case where the routine shown in FIG. 7 is executed, the above process sets the backfire flag XBF to 1 only when it can be estimated that backfire has occurred. Therefore, when the routine shown in FIG. 8 is executed, the apparatus according to the present embodiment implements the same functionality as the apparatus according to the third embodiment.

The fifth embodiment, which has been described above, constantly monitors the status of the pressure sensor 60 in order to detect the occurrence of backfire. However, the present invention is not limited to the use of such a detection method. Alternatively, the status of the pressure sensor 60 may be monitored in synchronism with a crank angle. More specifically, the status of the pressure sensor 60 may be monitored at a crank angle at which the intake valve opens for a cylinder (at a crank angle at which an abnormal pressure arises upon backfiring).

Sixth Embodiment

Configuration of Sixth Embodiment

A sixth embodiment of the present invention will now be described with reference to FIGS. 13 and 14.

Figure 13:
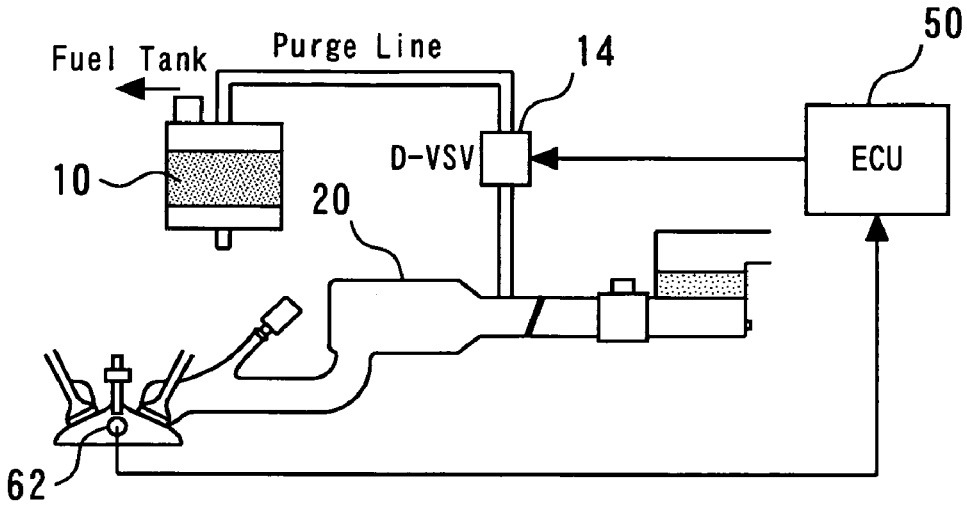
FIG. 13 illustrates a configuration of an evaporative fuel supply apparatus according to a sixth embodiment of the present invention.

FIG. 13 illustrates the configuration of the sixth embodiment of the present invention. The apparatus according to the present embodiment is implemented when the ECU 50, which is included in the configuration shown in FIG. 13, executes a routine shown in FIG. 14 together with the routine shown in FIG. 8.

The configuration shown in FIG. 13 is substantially the same as the configuration shown in FIG. 5 except that the former includes a combustion pressure sensor 62 for each cylinder of the internal combustion engine. The combustion pressure sensor 62 is positioned, for instance, on the cylinder head, and used to detect a combustion pressure that is generated in each cylinder.

As described earlier, backfire occurs when a fresh gas comes into contact with a high-temperature, high-pressure gas in a cylinder the moment the intake valve opens, thereby causing the fresh gas to unduly burn. When the fresh gas burns while the intake valve is open, the cylinder pressure is higher than a normal level. Therefore, when the output generated by the combustion pressure sensor 62 is monitored at about a crank angle at which the intake valve opens, it is possible to accurately detect the occurrence of backfire.

Details of Process Performed by Sixth Embodiment

Figure 14:
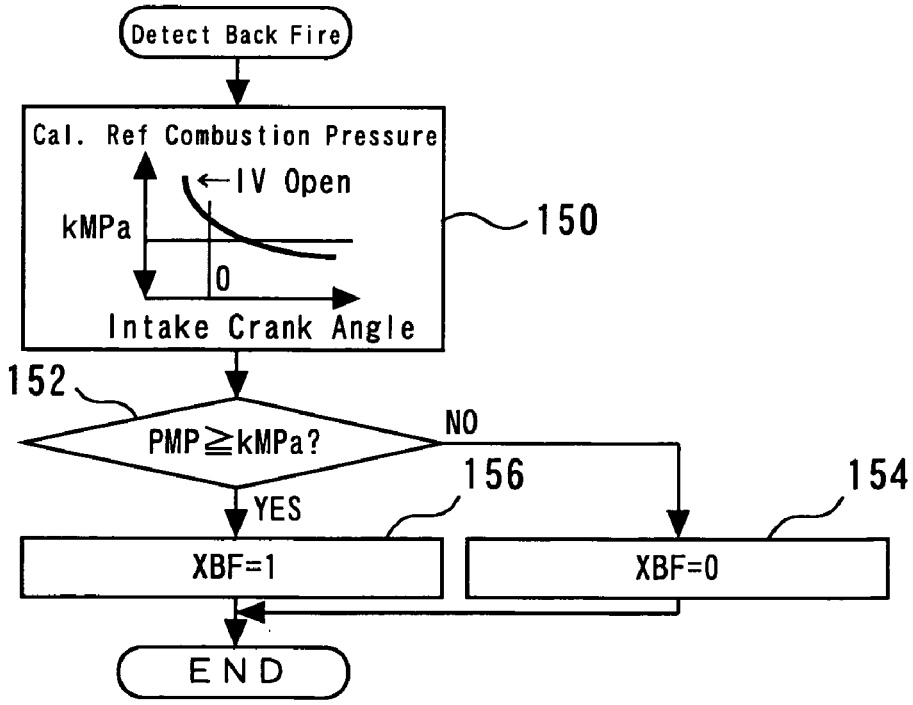
FIG. 14 is a flowchart illustrating a routine executed to detect a occurrence of backfire in the evaporative fuel supply apparatus according to the sixth embodiment of the present invention.

FIG. 14 is a flowchart illustrating a routine that the ECU 50 according to the present embodiment executes to detect the occurrence of backfire. This routine is started in synchronism with a crank angle, or more specifically, at a crank angle immediately after the intake valve opens for a cylinder.

When the routine shown in FIG. 14 is started, step 140 is performed to calculate a reference combustion pressure kMPa for the current operation status. While the internal combustion engine is conducting a normal operation, the combustion pressure (cylinder pressure) at about a crank angle at which the intake valve opens is roughly determined by the crank angle. The ECU 50 stores a map that defines the relationship between the combustion pressure and crank angle. In step 140, the map is referenced to calculate a combustion pressure (cylinder pressure) at a specific crank angle (at a crank angle prevailing immediately after the intake valve opens in the current operation state) as the reference combustion pressure kMPa.

Next, step 152 is performed to judge whether the combustion pressure PMP measured at the above specific crank angle is not lower than the reference combustion pressure kMPa. If the obtained judgment result does not indicate that PMP≦kMPa, it can be concluded that the combustion pressure PMP is normal. In this instance, it is judged that no backfire has occurred, and the backfire flag XBF is set to 0 (step 154).

If, on the other hand, the judgment result obtained in step 152 indicates that PMP≦kMPa, it can be concluded that the combustion pressure PMP at about a crank angle at which the intake valve opens is unduly high. In this instance, it is judged that backfire has occurred, and the backfire flag XBF is set to 1 (step 156).

As is the case where the routine shown in FIG. 7 is executed, the above process sets the backfire flag XBF to 1 only when it can be estimated that backfire has occurred. Therefore, when the routine shown in FIG. 8 is executed, the apparatus according to the present embodiment implements the same functionality as the apparatus according to the third embodiment.

The sixth embodiment, which has been described above, compares an instantaneous value of the combustion pressure PMP at a specific crank angle against the reference combustion pressure kMPa to judge whether backfire is generated. However, the present invention is not limited to the use of such a judgment method. For example, the above judgment may alternatively be formed by comparing the average value of the combustion pressure PMP prevailing over an appropriate period against the average value of the reference combustion pressure kMPa prevailing over an appropriate period.

Seventh Embodiment

Configuration of Seventh Embodiment

A seventh embodiment of the present invention will now be described with reference to FIGS. 15 and 16.

Figure 15:
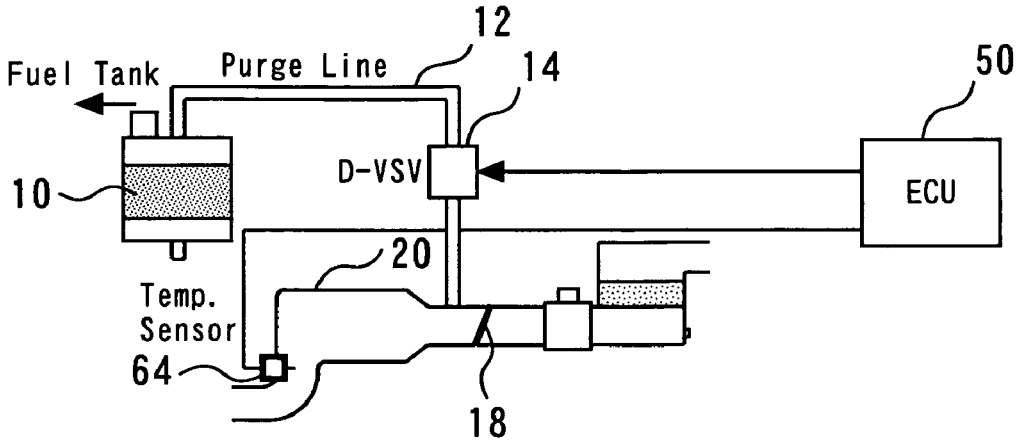
FIG. 15 illustrates a configuration of an evaporative fuel supply apparatus according to a seventh embodiment of the present invention.

FIG. 15 illustrates the configuration of the seventh embodiment of the present invention. The apparatus according to the present embodiment is implemented when the ECU 50, which is included in the configuration shown in FIG. 15, executes a routine shown in FIG. 16 together with the routine shown in FIG. 8.

The configuration shown in FIG. 15 is substantially the same as the configuration shown in FIG. 5 except that the former includes a temperature sensor 64 for detecting an internal combustion engine port temperature. When backfire is generated, air-fuel mixture combustion occurs inside an intake port. When such combustion occurs, the temperature inside the intake port is higher than normal. Therefore, when the port temperature is monitored by the temperature sensor 64, it is possible to accurately detect the occurrence of backfire.

Details of Process Performed by Seventh Embodiment

Figure 16:
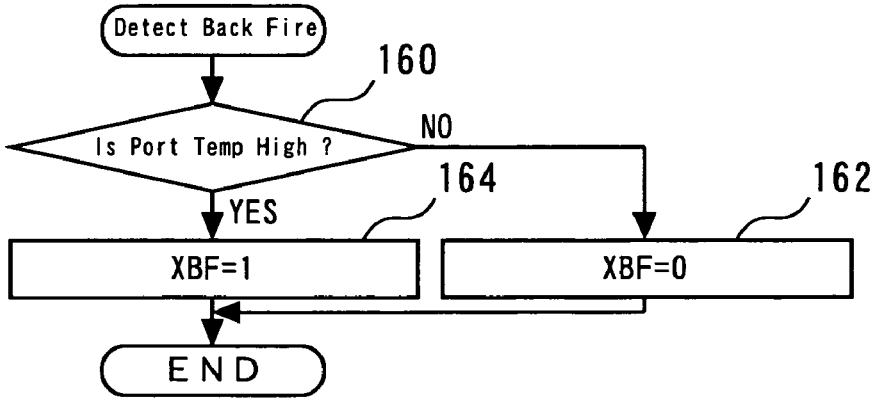
FIG. 16 is a flowchart illustrating a routine executed to detect a occurrence of backfire in the evaporative fuel supply apparatus according to the seventh embodiment of the present invention.

FIG. 16 is a flowchart illustrating a routine that the ECU 50 according to the present embodiment executes to detect the occurrence of backfire. This routine is repeatedly started at 4 msec or other sufficiently short intervals.

In the routine shown in FIG. 16, step 160 is first performed to judge whether the port temperature detected by the temperature sensor 64 is higher than a judgment value. The judgment value is appropriately predetermined as a value for judging whether backfire has occurred.

If the query in step 160 is answered "NO," it is concluded that no backfire has occurred, and the backfire flag XBF is set to 0 (step 162). If, on the other hand, the query in step 160 is answered "YES," it is concluded that backfire has occurred, and the backfire flag XBF is set to 1 (step 156).

As is the case where the routine shown in FIG. 7 is executed, the above process sets the backfire flag XBF to 1 only when it can be estimated that backfire has occurred. Therefore, when the routine shown in FIG. 8 is executed, the apparatus according to the present embodiment implements the same functionality as the apparatus according to the third embodiment.

The seventh embodiment, which has been described above, constantly monitors the output generated by the temperature sensor 64 in order to detect the occurrence of backfire. However, the present invention is not limited to the use of such a detection method. Alternatively, the output from the temperature sensor 64 may be monitored in synchronism with a crank angle. More specifically, the output from the temperature sensor 64 may be monitored at a crank angle at which the intake valve opens for a cylinder (at a crank angle at which an abnormal pressure arises upon backfiring).

Eighth Embodiment

Features of Eighth Embodiment

An eighth embodiment of the present invention will now be described with reference to FIG. 17.

Figure 17:
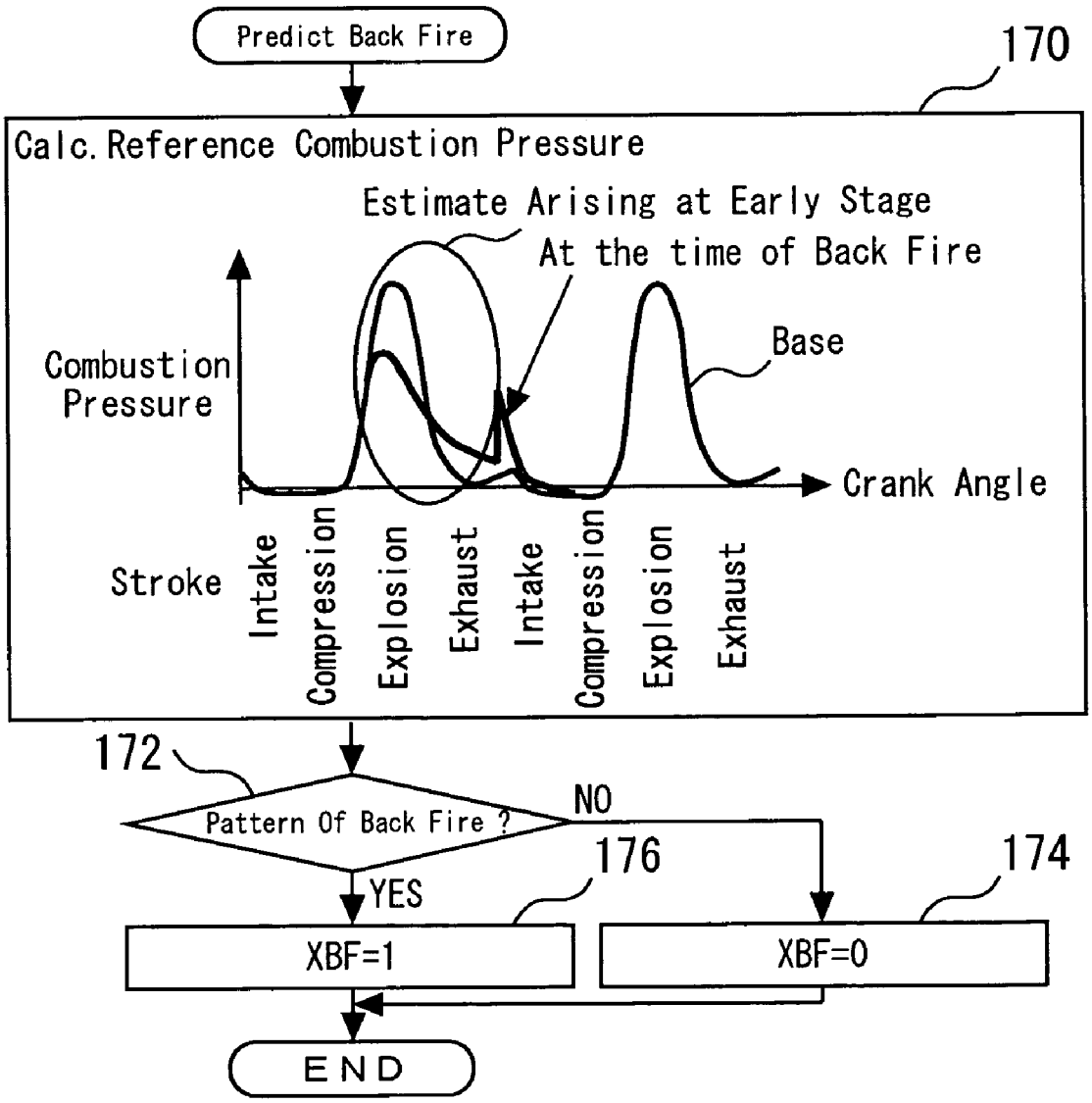
FIG. 17 is a flowchart illustrating a routine executed to detect a occurrence of backfire in an evaporative fuel supply apparatus according to a eighth embodiment of the present invention.

The apparatus according to the present embodiment is implemented when the hardware configuration (see FIG. 13) used in the sixth embodiment causes the ECU 50 to execute a routine shown in FIG. 17 together with the routine shown in FIG. 8.

As described earlier with reference to FIG. 6, backfire occurs if proper combustion is not obtained during the explosion stroke and cylinder combustion is not completed within a short period of time. If proper combustion does not occur during the explosion stroke, the combustion pressure for the explosion stroke is remarkably lower than normal. Therefore, when the combustion pressure pattern prevailing during the explosion stroke is viewed, it is possible to determine with high accuracy whether backfire occurs in the subsequent intake stroke.

As such being the case, the present embodiment monitors the output from the combustion pressure sensor 62 during the explosion stroke to obtain a combustion pressure pattern, and judges whether the obtained combustion pressure pattern invokes the occurrence of backfire. When the obtained judgment result indicates that backfire may occur, the present embodiment inhibits an evaporative fuel purge prior to the occurrence of backfire.

Details of Process Performed by Eighth Embodiment

FIG. 17 is a flowchart illustrating a routine that the ECU 50 executes to implement the above functionality, or more specifically, predict the occurrence of backfire during the explosion stroke. This routine is repeatedly started at 4 msec or other sufficiently short intervals.

In the routine shown in FIG. 17, step 170 is first performed to calculate the reference combustion pressure for the current crank angle and measure the current combustion pressure. The ECU 50 stores a map that defines the relationship between the reference combustion pressure and crank angle. In step 170, the map is referenced to calculate the reference combustion pressure that is appropriate for the current operation status and current crank angle.

Next, the measured combustion pressure is compared against the reference combustion pressure calculated as described above to judge whether the current combustion pressure pattern invokes the occurrence of backfire (step 172). The combustion pressure pattern for invoking the occurrence of backfire and the reference combustion pressure pattern greatly differ in the explosion stroke. Therefore, when step 172 is repeatedly performed, the generation of a pattern for invoking the occurrence of backfire can be recognized during the explosion stroke.

If the generation of a combustion pressure pattern for invoking the occurrence of backfire is not recognized in step 172, the backfire flag XBF is set to 0 (step 174). If, on the other hand, the generation of a combustion pressure pattern for invoking the occurrence of backfire is recognized in step 172, the backfire flag XBF is set to 1 (step 176).

When the conditions for backfiring are met in a certain cylinder, the above process can predict the occurrence of backfire and set the backfire flag XBF to 1 when the explosion stroke is performed in that cylinder. The backfire flag XBF is maintained at 1 until the combustion pressure within the cylinder (cylinder pressure) coincides with a normal combustion pressure (cylinder pressure). In other words, the backfire flag XBF is maintained at 1 until the intake stroke starts in the cylinder.

As is the case with the third to seventh embodiments, the ECU 50 according to the present embodiment executes the routine shown in FIG. 8. While the backfire flag XBF is 1, this routine prohibits a purge execution (see step 120 above) Therefore, when backfiring in a certain cylinder is predicted, the apparatus according to the present embodiment can prohibit a purge execution at least until the combustion pressure in the cylinder is restored to normal.

If, in a situation where the backfiring conditions are met during the explosion stroke, new evaporative fuel is not supplied subsequently while a high-temperature, high-pressure gas remains in the cylinder, no backfire occurs. Therefore, the apparatus according to the present embodiment makes it possible to avoid the occurrence of backfire and perfectly prevent the canister 10 and intake path 20 from being exposed to a backfiring-induced abnormal pressure.

The eighth embodiment, which has been described above, constantly monitors the output generated by the combustion pressure sensor 62 in order to detect the occurrence of backfire. However, the present invention is not limited to the use of such a detection method. Alternatively, the output from the combustion pressure sensor 62 may be monitored only for a period during which the explosion stroke is performed in a cylinder.

Ninth Embodiment

Configuration of Ninth Embodiment

A ninth embodiment of the present invention will now be described with reference to FIGS. 18 and 19.

Figure 18:
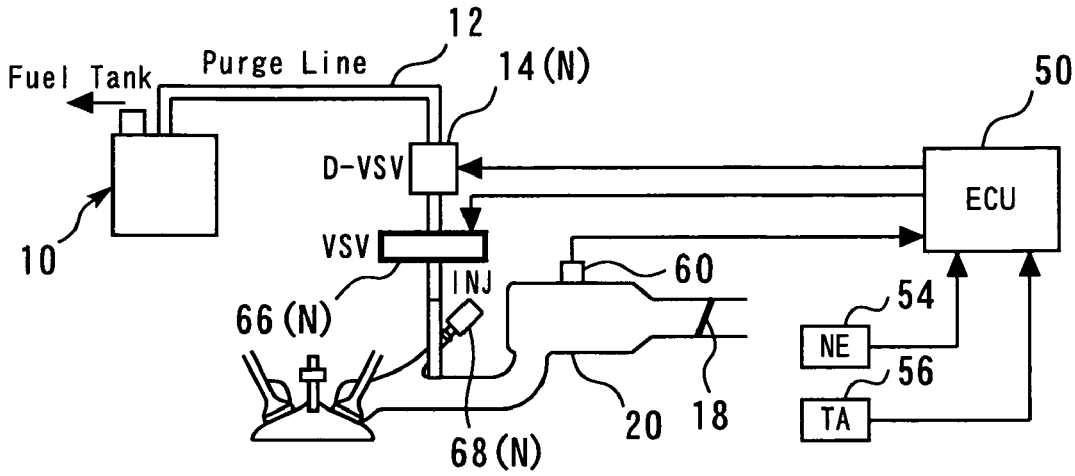
FIG. 18 illustrates a configuration of an evaporative fuel supply apparatus according to a ninth embodiment of the present invention.

FIG. 18 illustrates the configuration of the ninth embodiment of the present invention. The apparatus according to the present embodiment is implemented when the ECU 50, which is included in the configuration shown in FIG. 18, executes a routine shown in FIG. 19.

Within the apparatus shown in FIG. 18, the end of the purge line 12 communicates with an intake port of each cylinder. The purge line 12 incorporates a plurality of D-VSVs 14 (N) and a flow rate changeover VSVs 66 (N), which correspond to individual cylinders (the symbol "N" represents a cylinder number). The flow rate changeover VSVs 66 (N) are changeover valves that are capable of selectively providing a high flow rate by increasing the effective diameter of the purge line 12 and a low flow rate by decreasing the effective diameter of the purge line 12. Therefore, the apparatus according to the present embodiment can change the air flow resistance between the intake path 20 and canister 10 by changing the status of the flow rate changeover VSV 66 (N) and without changing the control exercised by a D-VSV 14 (N).

The plurality of D-VSVs 14 (N) incorporated in the purge line 12 can supply evaporative fuel to the cylinders of the internal combustion engine with each individual timing. Further, a plurality of fuel injection valves 68 (N) are installed in the intake path 20 to inject fuel into the cylinders. Therefore, the apparatus according to the present embodiment can operate the fuel injection valves 68 (N) to supply liquid fuel to the individual cylinders and operate the D-VSVs 14 (N) to supply evaporative fuel to the individual cylinders.

The configuration shown in FIG. 18 is substantially the same as the configuration shown in FIG. 11 (fifth embodiment) except that the D-VSVs 14 (N) are provided for all cylinders and that the purge line 12 incorporates the flow rate changeover VSVs 66 (N). The other elements, which are identical with those described with reference to FIG. 11 are designated by the same reference numerals as their counterparts and omitted from the description.

Details of Process Performed by Ninth Embodiment

As is the case with the third to eighth embodiments, which have been described above, the apparatus according to the present embodiment purges the canister 10 and supplies evaporative fuel to the intake path 20 when the internal combustion engine cold starts. In this instance, the D-VSVs 14 (N) properly open so that appropriate amounts of evaporative fuel are supplied to the individual cylinders.

As far as an internal combustion engine operation is normally conducted, it is required that the air flow resistance in the purge line 12 be small for the purpose of providing an adequate amount of evaporative fuel supply. However, if backfire occurs during an evaporative fuel purge, it is required that the air flow resistance in the purge line 12 be great for the purpose of minimizing the influence of pressure wave propagation to the canister 10. The apparatus according to the present embodiment can satisfy these two requirements by changing the status of the flow rate changeover VSVs 66 (N) upon backfire detection.

Figure 19:
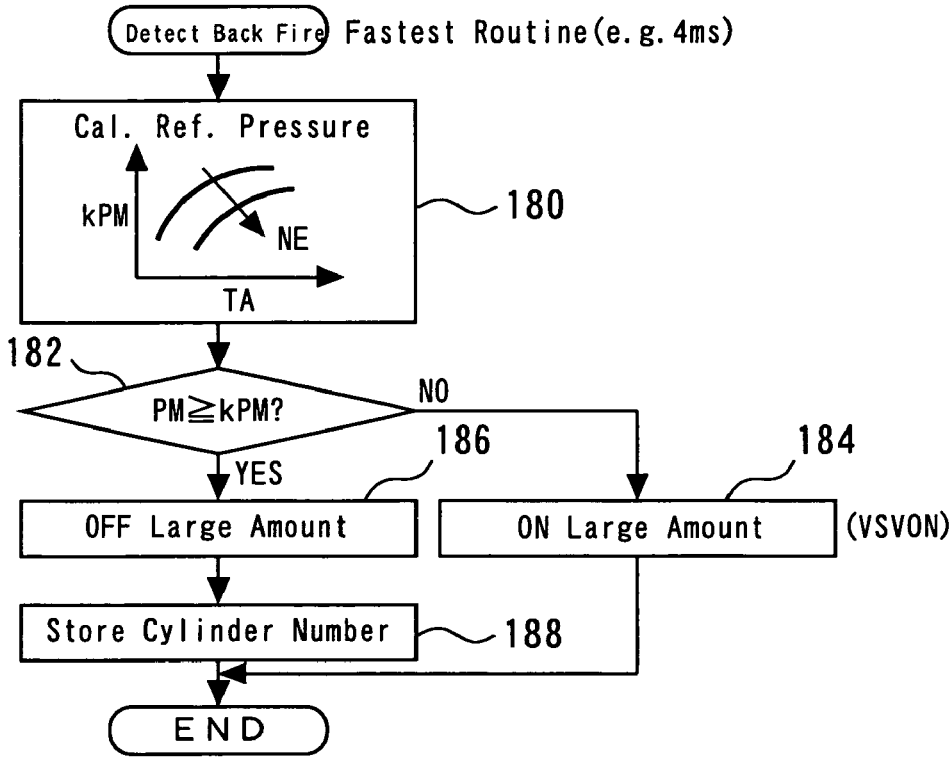
FIG. 19 is a flowchart illustrating a routine executed in the evaporative fuel supply apparatus according to the ninth embodiment of the present invention.

FIG. 19 is a flowchart illustrating a routine that the ECU 50 according to the present embodiment executes to satisfy the above requirements. This routine is repeatedly started at 4 msec or other sufficiently short intervals.

In the routine shown in FIG. 19, step 180 is first performed to calculate the reference pressure kPM for the current operation status. Next, step 182 is performed to judge whether the measured intake pressure PM is not lower than the reference pressure kPM. The processes performed in these steps will not be described in detail because they are the same as those performed in steps 140 and 142, which are shown in FIG. 12.

If the judgment result obtained in step 182 does not indicate that PM≧kPM, it is concluded that the intake pressure PM is proper and that no backfire has occurred. In this instance, all the flow rate changeover VSVs 66 (N) are turned ON to provide a high flow rate for the purpose of keeping the air flow resistance in the purge line 12 small (step 184).

If, on the other hand, the judgment result obtained in step 182 indicates that PM≧kPM, it is concluded that backfire has occurred. In this instance, all the flow rate changeover VSVs 66 (N) are turned OFF to provide a low flow rate (step 186). Further, a cylinder in which backfire is generated is stored in memory (step 188). When the above process is performed, it is possible to decrease the effective diameter of the purge line 12 upon backfiring, thereby increasing the air flow resistance in the purge line 12.

When backfire is detected, the apparatuses according to the third to eighth embodiments closes the D-VSV 14 to inhibit a purge. In this instance, the pressure propagation to the canister 10 is perfectly stopped. Therefore, the canister 10 is sufficiently protected. However, when the pressure propagation from the intake path 20 to the canister 10 is perfectly stopped at the time of backfiring, the pressure within the intake path 20 may temporarily rise to an unduly high level.

When the flow rate is low, the flow rate changeover VSVs 66 (N) for use in the present embodiment provides a certain degree of pressure release from the intake path 20 to the canister 10 without damaging the canister 10 at the time of backfiring. When this configuration is employed, it is possible to control the pressure increase in the intake path 20 without damaging the canister 10 at the time of backfiring. Therefore, the apparatus according to the present embodiment can protect both the canister 10 and intake path 20 from the influence of backfiring.

The ninth embodiment, which has been described above, sets the flow rate changeover VSVs 66 (N) for all the cylinders to provide a low flow rate when the occurrence of backfire is recognized. However, the present invention is not limited to such a flow rate change. Alternatively, only the flow rate changeover VSV 66 (N) for a cylinder in which backfire is generated may be set to provide a low flow rate.

The ninth embodiment, which has been described above, provides the D-VSVs 14 (N) and flow rate changeover VSVs 66 (N) for all cylinders. However, the present invention is not limited to the use of such a configuration. Alternatively, a D-VSV and a flow rate changeover VSV may be shared by all cylinders (that is, the purge line 12 may communicate with a section directly below the throttle valve 18 as is the case with the third to eighth embodiments).

The ninth embodiment, which has been described above, uses the backfire detection method that is used in the fifth embodiment. However, the present invention is not limited to the use of such a detection method. Alternatively, backfire may be detected by any method that is used in the third, fourth, sixth, seventh, or eighth embodiment.

Tenth Embodiment

Configuration of Tenth Embodiment

A tenth embodiment of the present invention will now be described with reference to FIGS. 20 to 22.

Figure 20:
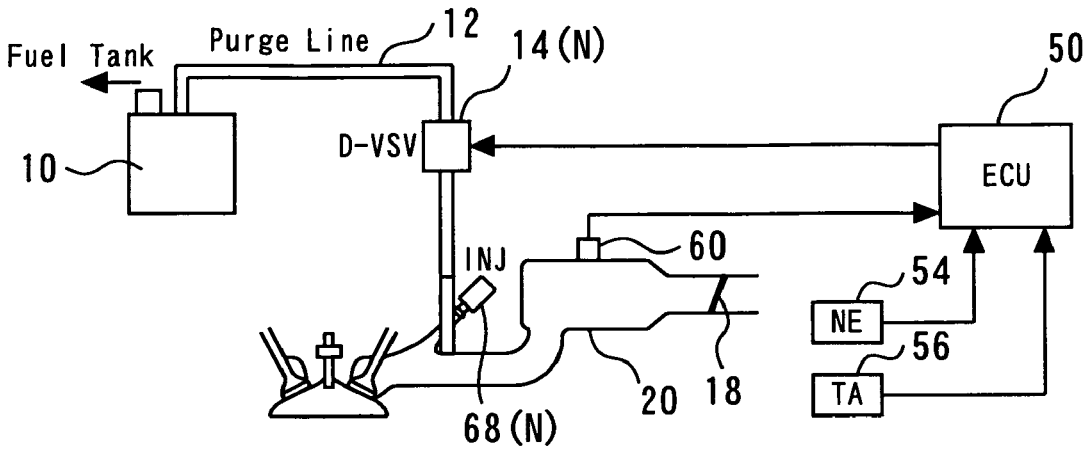
FIG. 20 illustrates a configuration of an evaporative fuel supply apparatus according to a tenth embodiment of the present invention.

FIG. 20 illustrates the configuration of the tenth embodiment of the present invention. The apparatus according to the present embodiment is implemented when the ECU 50, which is included in the configuration shown in FIG. 20, executes routines shown in FIGS. 21 and 22 together with the routine shown in FIG. 12.

The configuration shown in FIG. 20 is substantially the same as the configuration shown in FIG. 18 (ninth embodiment) except that the former excludes the flow rate changeover VSVs 66 (N). In other words, the apparatus according to the present embodiment includes a pressure sensor 60 for detecting the pressure within the intake path 20. The apparatus according to the present embodiment also includes the D-VSV 14 (N) and fuel injection valve 68 (N), which are provided for each cylinder.

Details of Process Performed by Tenth Embodiment

As is the case with the third to ninth embodiments, which have been described above, the apparatus according to the present embodiment supplies evaporative fuel to the intake path 20 when the internal combustion engine cold starts. As is the case with the apparatus according to the fifth embodiment, the apparatus according to the present embodiment executes the routine shown in FIG. 12 to detect the occurrence of backfire.

When backfire occurs in a certain cylinder, the routine shown in FIG. 12 detects an abnormal intake pressure PM immediately after the intake valve for the cylinder opens, and sets the backfire flag XBF to 1. The apparatus according to the present embodiment opens the D-VSV 14 (N) for each cylinder when the intake stroke is performed in each cylinder. Within each cylinder, the intake valve opens at a predetermined crank angle before an intake top dead center, and the D-VSV 14 (N) subsequently opens at a position near the intake top dead center.

When backfire occurs in a certain cylinder, the intake pressure PM is maintained at an abnormal pressure level during the time interval between the instant at which the intake valve for the cylinder opens and the instant at which the cylinder exceeds at least the intake top dead center. Therefore, when backfire occurs in a certain cylinder, the routine shown in FIG. 12 sets the backfire flag XBF to 1 before the D-VSV 14 (N) for the cylinder opens. Subsequently, the backfire flag XBF is maintained at 1 at least until the D-VSV 14 (N) opens.

As explained in conjunction with the ninth embodiment, it is required that the air flow resistance in the purge line 12 be small while a normal operation is conducted and great when backfire is generated. When backfire is generated, the apparatus according to the present embodiment satisfies the above requirements by ensuring that the time during which the D-VSV 14 (N) is open is shorter than normal.

Figure 21:
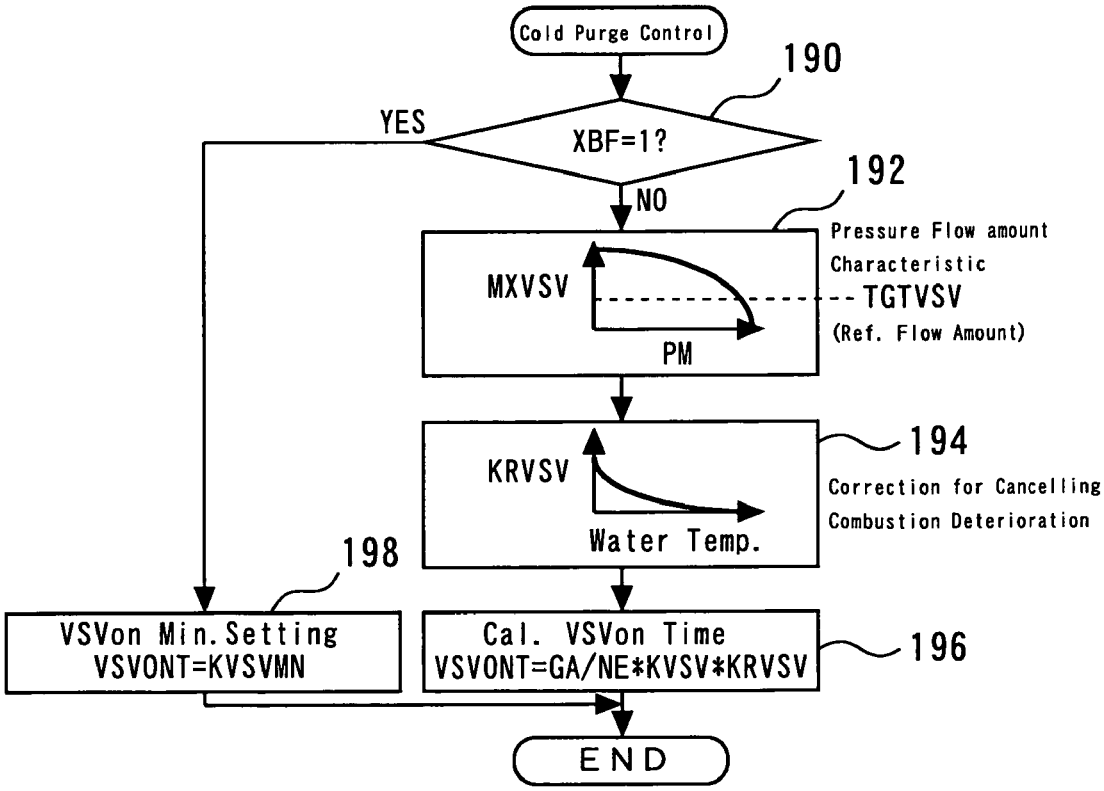
FIG. 21 is a flowchart illustrating a routine executed to calculate the ON time VSVONT for operating the D-VSV in the evaporative fuel supply apparatus according to the tenth embodiment.

FIG. 21 is a flowchart illustrating a routine that the ECU 50 according to the present embodiment executes to implement the above functionality. This routine is repeatedly executed at 4 msec or other sufficiently short intervals.

In the routine shown in FIG. 21, step 190 is first performed to judge whether the backfire flag XBF is set to 1. If the obtained judgment result does not indicate that XBF=1, it is concluded that no backfire has occurred. In this instance, the ON time VSVONT for operating the D-VSV 14 (N) to supply the necessary amount of fuel to each cylinder for stable internal combustion engine operation is calculated.

More specifically, step 192 is first performed to calculate a maximum flow rate MXVSV. The maximum flow rate MXVSV is a purge flow rate that is obtained when the D-VSV 14 (N) is fully open under the current intake pressure PM. The ECU 50 stores a map that defines the relationship between the maximum flow rate MXVSV and intake pressure PM. In step 192, the map is referenced to calculate the maximum flow rate MXVSV.

Next, step 194 is performed to calculate an increase coefficient KRVSV for a cold start. The increase coefficient KRVSV is a coefficient that increases the amount of fuel to stabilize the internal combustion engine at a low cooling water temperature. The ECU 50 stores a map that defines the relationship between the increase coefficient KRVSV and cooling water temperature. In step 194, the increase coefficient KRVSV is calculated in accordance with the map.

The following equation is used to calculate the ON time VSVONT for operating the D-VSV 14 (N) to supply the necessary amount of fuel to each cylinder (step 196):

$$VSVONT=GA/NE\times KVSV\times KRVSV \quad (1)$$

where the value KVSV is obtained when a reference flow rate TGTVSV is divided by the maximum flow rate MXVSV (KVSV=TGTVSV/MXVSV), and the reference flow rate TGTVSV is a reference purge flow rate for the internal combustion engine.

When no backfire is recognized, the above process sets the time for purging a desired amount of fuel to each cylinder as the ON time VSVONT for the D-VSV 14 (N). In this instance, the D-VSV 14 (N) opens for the preselected ON time VSVONT during the intake stroke in each cylinder so that the internal combustion engine can be steadily operated.

As described earlier, when backfire occurs in a certain cylinder, the backfire flag XBF is set to 1 during the time interval between the instant at which the intake valve for the cylinder opens and the instant at which at least the D-VSV 14 (N) for the cylinder opens. In this instance, the judgment result obtained in step 190, which is a part of the routine shown in FIG. 21, indicates that XBF=1.

When the judgment result obtained in step 190 indicates that XBF=1, a minimum time KVSVMN is set as the ON time VSVONT for the D-VSV 14 (N) (step 198). The minimum time KVSVMN is set as the time during which the pressure within the intake path 20 is released while protecting the canister 10 at the time of backfiring. Therefore, when the occurrence of backfire is recognized in a certain cylinder, the time for protecting both the canister 10 and intake path 20 from the resulting abnormal pressure is set as the ON time VSVONT for the D-VSV 14 (N).

Figure 22:
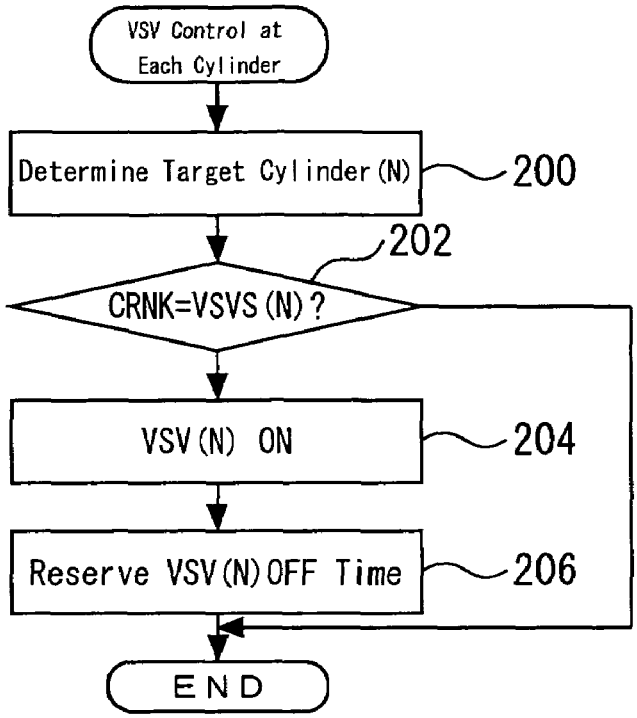
FIG. 22 is a flowchart illustrating a routine executed to drive the D-VSV in accordance with the ON time VSVONT in the evaporative fuel supply apparatus according to the tenth embodiment of the present invention.

FIG. 22 is a flowchart illustrating a routine that the ECU 50 executes to drive the D-VSV 14 (N) in accordance with the ON time VSVONT, which is set as described above. The routine shown in FIG. 22 is repeatedly executed at 4 msec or other sufficiently short intervals.

In the routine shown in FIG. 22, step 200 is first performed to determine a cylinder (N) for which the drive of the D-VSV 14 (N) is to be requested, that is, determine a cylinder in which the intake stroke is about to be performed or a cylinder in which the intake stroke is being performed. This cylinder is hereinafter referred to as the "target cylinder (N)."

When the target cylinder (N) is determined, step 202 is performed to judge whether the current crank angle CRNK agrees with the VSV valve opening timing VSVS (N) of the target cylinder (N). The VSV valve opening timing VSVS (N) is preadjusted, for instance, for the timing with which a piston in the target cylinder (N) reaches the top dead center.

If the judgment result obtained in step 202 does not indicate that CRNK=VSVS (N), the current process immediately terminates. If, on the other hand, the obtained judgment result indicates that CRNK=VSVS (N), step 204 is performed to turn ON or open the D-VSV 14 (N) for the target cylinder. Further, step 206 is performed to reserve the OFF time for the D-VSV 14 (N).

At the time at which step 206 is performed, that is, at the time at which the crank angle of the target cylinder (N) passes through a position near the top dead center, the routine shown in FIG. 12 is already performed to judge whether backfire is generated in the target cylinder. If the occurrence of backfire is not recognized, the ON time VSVONT for obtaining a desired amount of fuel is set. If the occurrence of backfire is recognized, the minimum time KVSVMN is set as the ON time VSVONT.

In step 206, the ECU 50 reserves the OFF time for the D-VSV 14 (N) in accordance with the ON time VSVONT that is already calculated. More specifically, the time prevailing when the already calculated ON time VSVONT elapses after the ON time VSVS (N) for the D-VSV 14 (N) is set as the OFF time.

When the OFF time comes, the ECU 50 turns OFF or closes the D-VSV 14 (N) for the target cylinder. If no backfire is generated in the target cylinder, the above process supplies an adequate amount of evaporative fuel to the target cylinder by opening the D-VSV (N) for a sufficiently long period of time after the valve opening timing VSVS (N). If backfire is generated in the target cylinder, the abnormal pressure within the intake path 20 is partly released to the canister 10 to protect the intake path 20 while preventing the unduly high pressure from propagating to the canister 10 by reducing the time during which the D-VSV 14 (N) is open. Therefore, the apparatus according to the present embodiment substantially provides the same advantage as the apparatus according to the ninth embodiment, or more specifically, protects both the canister 10 and intake path 20 from the influence of backfire.

The tenth embodiment, which has been described above, employs a hardware configuration in which the D-VSV 14 (N) is provided for each cylinder. However, the present invention is not limited to the use of such a hardware configuration. More specifically, the D-VSV may be shared by all cylinders as is the case with the third to eighth embodiments. When the D-VSV is driven in synchronism with the intake stroke of each cylinder in a situation where the D-VSV is shared by all cylinders, it is possible to provide virtually the same advantage as the tenth embodiment.

The tenth embodiment, which has been described above, detects backfire by the method that is used in the fifth embodiment. However, the present invention is not limited to the use of such a detection method. Alternatively, backfire may be detected by any method that is used in the third, fourth, sixth, seventh, or eighth embodiment.

The tenth embodiment, which has been described above, repeatedly performs a VSVONT setup process (routine shown in FIG. 21) at predetermined time intervals. However, the present invention is not limited to the use of such a setup method. Alternatively, the VSVONT setup process may be performed in synchronism with a crank angle, or more specifically, performed at a crank angle at which the intake valve for an individual cylinder opens (at a crank angle at which the backfire flag XBF is set to 1).

Eleventh Embodiment

Features of Eleventh Embodiment

An eleventh embodiment of the present invention will now be described with reference to FIGS. 23 to 25.

Figure 23:
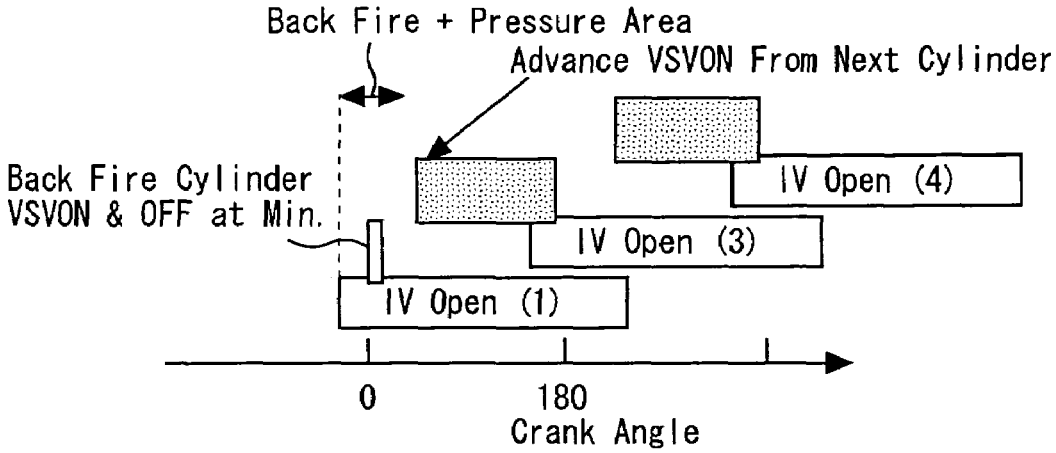
FIG. 23 is a timing diagram illustrating an operation that is particular to an evaporative fuel supply apparatus according to an eleventh embodiment of the present invention.

FIG. 23 is a timing diagram illustrating an operation that is particular to the apparatus according to the present embodiment. More specifically, this timing diagram illustrates an operation that the apparatus according to the present embodiment performs when backfire occurs during the intake stroke of a first cylinder.

The present embodiment uses a four-cylinder internal combustion engine. The first cylinder, third cylinder, fourth cylinder, and second cylinder perform the intake stroke repeatedly in order named. In FIG. 23, the expressions "IV Open (1)," "IV Open (3)," and "IV Open (4)" respectively represent the periods during which the intake valve is open for the first cylinder, third cylinder, and fourth cylinder.

In a situation where the occurrence of backfire is not recognized, the apparatus according to the present embodiment begins to perform a purge (opens the D-VSV) at the intake top dead center after the intake valve for a cylinder opens. If no backfire is generated, the apparatus according to the present embodiment sets the ON time VSVONT for purging a desired amount of fuel, and terminates the purge (closes the D-VSV 14) when the ON time VSVONT elapses. If, on the other hand, the occurrence of backfire is recognized, the apparatus according to the present embodiment sets the minimum time KVSVMN as the ON time VSVONT, and terminates the purge (closes the D-VSV) when the minimum time KVSVMN elapses. The above operation is the same as the operation performed in the tenth embodiment.

As mentioned earlier, FIG. 23 illustrates an example in which backfire is generated in the first cylinder. In the example, therefore, the purge begins at a position near the intake top dead center during the intake stroke of the first cylinder, and terminates when the minimum time KVSVMN elapses.

When the occurrence of backfire is recognized during the intake stroke of a certain cylinder, the apparatus according to the present embodiment extends the purge execution period and advances the purge start time for a plurality of subsequent intake strokes (hereinafter referred to as the "post-backfiring intake strokes"). FIG. 23 indicates, as a result of the above process, that the purges corresponding to the intake strokes of the third and fourth cylinders begin at approximately 150° CA before intake top dead center (BTDC) and continue for a sufficiently long period of time.

Backfire occurs when the combustion in a cylinder is improper due to insufficient fuel supply to the internal combustion engine. When backfire occurs in a certain cylinder, it is conceivable that the amounts of fuel supply to the other cylinders may also be insufficient. In other words, when backfire occurs during the intake stroke of a certain cylinder and the fuel supply operation is continuously conducted without changing the conditions, it is predicted that backfire will occur during the subsequent post-backfiring intake strokes successively or frequently.

If the post-backfiring intake strokes are provided with a sufficiently long purge period, an increased amount of evaporative fuel can be supplied by a purge. Further, when the purge period is extended with the purge start time advanced, the latter half of the purge period will not enter a crank angle region where the intake efficiency is low. Consequently, the amount of fuel supply by a purge can be further increased. Therefore, the apparatus according to the present embodiment makes it possible to effectively prevent backfire from occurring successively or frequently during the post-backfiring intake strokes.

Details of Process Performed by Eleventh Embodiment

Figure 24:
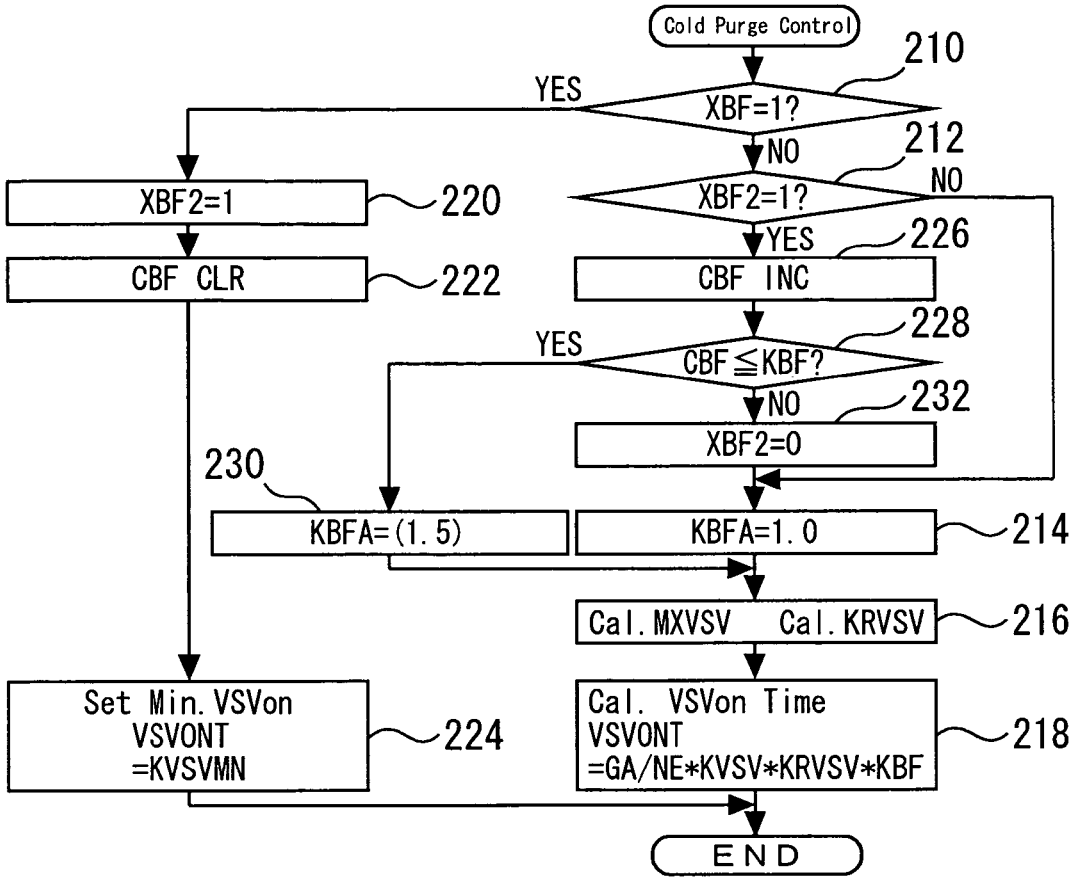
FIG. 24 is a flowchart illustrating a routine executed to calculate the ON time VSVONT for operating the D-VSV in the evaporative fuel supply apparatus according to the eleventh embodiment of the present invention.
Figure 25:
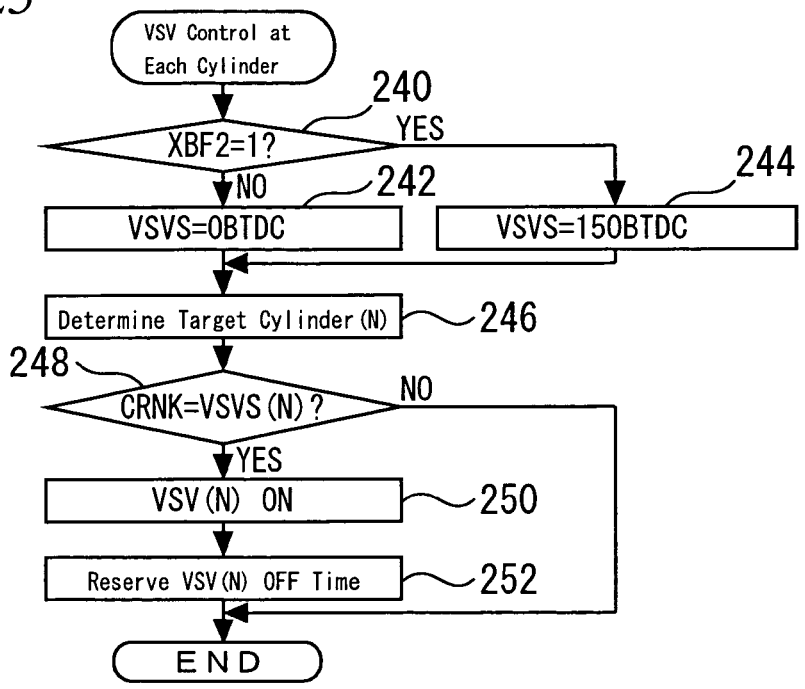
FIG. 25 is a flowchart illustrating a routine executed to control the valve opening period of the D-VSV in the evaporative fuel supply apparatus according to the eleventh embodiment of the present invention.

The apparatus according to the present embodiment is implemented when, for instance, the ECU 50, which is included in the hardware configuration shown in FIG. 20 (the configuration of the tenth embodiment), executes routines shown in FIGS. 24 and 25 together with the routine shown in FIG. 12.

FIG. 24 is a flowchart illustrating a routine that is executed to set the ON time VSVONT for the D-VSV 14 (N) corresponding to an individual cylinder depending on whether backfire is generated. This routine is repeatedly executed at 4 msec or other sufficiently short intervals.

In the routine shown in FIG. 24, step 210 is first performed to judge whether the backfire flag XBF is set to 1. When the occurrence of backfire is not recognized, the backfire flag XBF is set to 0. In such an instance, the query in step 210 is answered "NO."

When the query in step 210 is answered "NO," step 212 is performed to judge whether a second backfire flag XBF2 is set to 1. The second backfire flag XBF2 is initially set to 0. Therefore, when the occurrence of backfire is not recognized, the query in step 212 is answered "NO." In this instance, an ON time correction coefficient KBFA is set to a reference value of 1.0 (step 214).

Next, step 216 is performed to calculate the purge maximum flow rate MXVSV, which is obtained by fully opening the D-VSV 14 (N), and the increase coefficient KRVSV, which makes it possible to increase the amount of fuel supply for cold startup. The process performed in this step is the same as those performed in steps 192 and 194, which are shown in FIG. 21.

The following equation is used to calculate the ON time VSVONT for operating the D-VSV 14 (N) to supply the necessary amount of fuel (step 218):

$$VSVONT=GA/NE\times KVSV\times KRVSV\times KBFA \quad (2)$$

Since the ON time correction coefficient KBFA is set to a reference value of 1.0, Equation (2) indicates that the ON time VSVONT is equal to GA/NE×KVSV×KRVSV. As is the case with the value calculated in step 196 for the tenth embodiment, the ON time VSVONT denotes the time for opening the D-VSV 14 (N) in synchronism with the intake stroke of a cylinder in order to steadily operate the internal combustion engine.

When backfire occurs in a certain cylinder, the backfire flag XBF is set to 1 during the time interval between the instant at which the intake valve for the cylinder opens and the instant at which the D-VSV 14 (N) for the cylinder opens. In this instance, the judgment result obtained in step 210, which is a part of the routine shown in FIG. 24, indicates that XBF=1.

When the judgment result obtained in step 210 indicates that XBF=1, the second backfire flag XBF2 is set to 1 (step 220). Next, the backfire counter CBF is cleared (step 222). Step 224 is then performed to set the minimum time KVSVMN as the ON time VSVONT for the D-VSV 14 (N). When the occurrence of backfire is recognized in a certain cylinder, the routine shown in FIG. 24 can set the minimum time KVSVMN as the ON time VSVONT for the D-VSV 14 (N) that relates to the cylinder.

When the intake pressure PM within a cylinder in which backfire is generated lowers to a normal level, the backfire flag XBF is set to 0. When the backfire flag XBF reverts to 0, the subsequent judgment result obtained in step 210 does not indicate that XBF=1. Therefore, step 212 is performed again.

Since the second backfire flag XBF2 is set to 1 at the time of backfiring, a check is now conducted to judge whether XBF2=1. In this instance, the backfire counter CBF is first incremented (step 226), and then step 124 is performed to judge whether the resulting count CBF is not greater than the judgment value KBF.

When the above process is performed, the backfire counter CBF counts the elapsed time after vanishment of the abnormal pressure caused by backfiring. The judgment value KBF represents the time required for repeating the post-backfiring intake stroke a predetermined number of times. In other words, the judgment value KBF denotes the time required for avoiding the occurrence of backfire with a view toward a fuel increase.

If the judgment result obtained in step 228, which is shown in FIG. 24, still indicates that CBF≦KBF, it can be concluded that the time for a fuel increase has not elapsed. In this instance, the value 1.5, which is greater than the reference value (1.0), is set as the ON time correction coefficient KBFA. When the value 1.5 is set as the ON time correction coefficient KBFA, the ON time VSVONT calculated in step 218, which is performed subsequently, is 1.5 times the reference ON time. Therefore, the above process can increase the amount of an internal combustion engine purge to effectively avoid the occurrence of backfire during the time interval between the instant at which the occurrence of backfire is recognized and the instant at which the post-backfiring intake stroke is performed a predetermined number of times.

When the amount of fuel is increased for a predetermined period of time so that the count reached by the backfire counter CBF is greater than the judgment value KBF, the query in step 228 is answered "NO." In this instance, the second backfire flag XBF2 is set to 0 (step 232), the ON time correction coefficient KBFA is reset to a reference value of 1.0, and steps 216 and beyond are performed. As a result, the ON time VSVONT for each D-VSV 14 (N) reverts to the time required for steadily operating the internal combustion engine.

As described above, when the occurrence of backfire is recognized during the intake stroke of a certain cylinder, the routine shown in FIG. 24 immediately sets the minimum time KVSVMN as the ON time VSVONT for the D-VSV 14 (N) during the intake stroke, and ensures that the ON time VSVONT for the post-backfiring intake strokes is 1.5 times the reference ON time for a predetermined period of time. Therefore, the apparatus according to the present embodiment prevents the abnormal pressure in a cylinder where backfire is generated from further increasing, and effectively avoids the successive or frequent recurrence of backfire.

FIG. 25 is a flowchart illustrating a routine that the ECU 50 executes in order to control the valve opening period of the D-VSV 14 (N). As is the case with the routine shown in FIG. 24, the routine shown in FIG. 25 is repeatedly started at predetermined short intervals.

In the routine shown in FIG. 25, step 240 is first performed to judge whether the second backfire flag XBF2 is set to 1. If the occurrence of backfire is not recognized, the second backfire flag XBF2 is maintained at 0. The second backfire flag XBF2 is also maintained at 0 during the time interval between the instant at which the occurrence of backfire is recognized and the instant at which the backfiring-induced abnormal pressure vanishes (see FIG. 24) In these cases, the valve opening timing VSVS (N) for the D-VSV 14 (N) is set at the intake top dead center (0° CA BTDC) (step 142).

While the post-backfiring intake stroke is performed a predetermined number of times after backfiring, the second backfire flag XBF2 is set to 1 (see FIG. 24). In this instance, the valve opening timing VSVS (N) for the D-VSV 14 (N) is set at 150° CA before the intake top dead center (150° CA BTDC) (step 244).

In the routine shown in FIG. 25, step 246 is performed to determine the target cylinder (N), that is, the cylinder that is about to perform the intake stroke or the cylinder that is performing the intake stroke. When the current crank angle CRNK agrees with the VSV opening timing VSVS (N) for the target cylinder (N), the D-VSV 14 (N) for the target cylinder opens and the OFF time for the D-VSV 14 (N) is reserved (steps 248 to 252).

If the target cylinder is a cylinder in which backfire is generated, that is, the first cylinder shown in FIG. 23, the valve opening timing VSVS (N) is set at 0° CA BTDC in step 242. When the current crank angle CRNK coincides with 0° CA BTDC, step 250 is performed to turn ON the D-VSV 14 (N) for the cylinder, and then step 252 is followed to perform setup so that the OFF time setting for the D-VSV 14 (N) is later than the current time by the minimum time KVSVMN.

If the target cylinder is the third or fourth cylinder in FIG. 23, that is, the cylinder for which the amount of fuel should be increased, the valve opening timing VSVS (N) is set at 150° CA BTDC in step 244. When the current crank angle CRNK coincides with 150° CA BTDC, step 250 is performed to turn ON the D-VSV 14 (N) for the target cylinder, and then step 252 is followed to perform setup so that the OFF time setting for the D-VSV 14 (N) is later than the current time by the ON time VSVONT, which is 1.5 times the reference ON time.

The process described above performs an evaporative fuel purge for each cylinder in synchronism with the intake stroke for each cylinder and in a pattern shown in FIG. 23 depending on whether backfire is generated. Therefore, the apparatus according to the present embodiment protects both the canister 10 and intake path 20 during an intake stroke in which backfire is generated, and avoids the successive or frequent occurrence of backfire during the post-backfiring intake strokes.

The eleventh embodiment, which has been described above, provides the D-VSV 14 (N) for each cylinder. However, the present invention is not limited to the use of such a configuration. Alternatively, the D-VSV may be shared by all cylinders as is the case with the third to eighth embodiments. When, in such an instance, the D-VSV operates in synchronism with the intake stroke of each cylinder, it is possible to provide virtually the same advantage as the eleventh embodiment, which has been described above.

The eleventh embodiment, which has been described above, uses the same backfire detection method as the fifth embodiment. However, the present invention is not limited to the use of such a detection method. Alternatively, backfire may be detected by any method that is used in the third, fourth, sixth, seventh, or eighth embodiment.

Twelfth Embodiment

A twelfth embodiment will now be described with reference to FIG. 26. The apparatus according to the present embodiment is implemented when the ECU 50, which is included in the apparatus according to the eleventh embodiment, executes a routine shown in FIG. 26 instead of the routine shown in FIG. 24.

Figure 26:
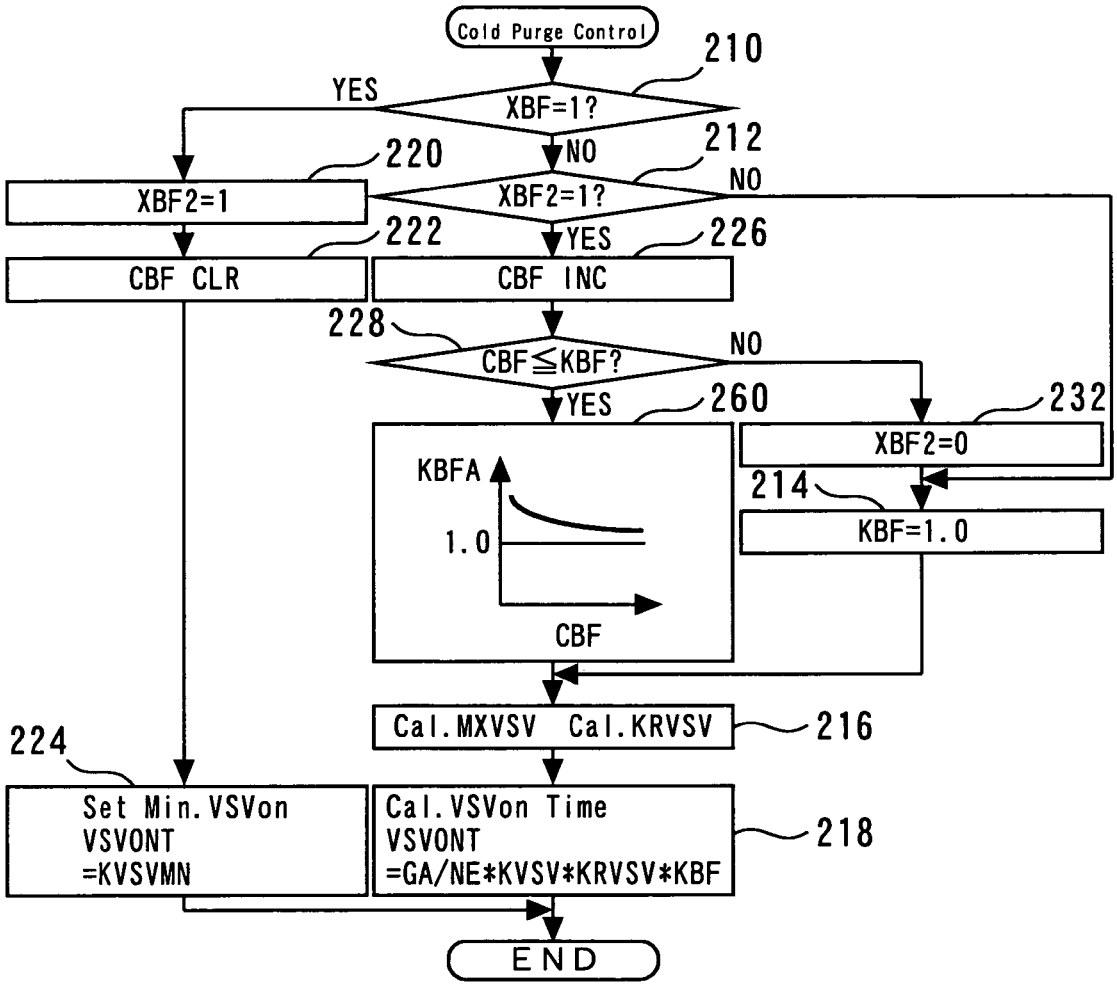
FIG. 26 is a flowchart illustrating a routine executed to calculate the ON time VSVONT for operating the D-VSV in an evaporative fuel supply apparatus according to a twelfth embodiment of the present invention.

FIG. 26 is a flowchart illustrating a routine that the ECU 50 executes to set the ON time VSVONT for the D-VSV 14 (N) that relates to an individual cylinder. The routine shown in FIG. 26 is the same as the routine shown in FIG. 24 except that step 230 is superseded by step 260.

In other words, the routine shown in FIG. 24 repeatedly performs step 230 during the time interval between the instant at which the occurrence of backfire is recognized and the instant at which the count reached by the backfire counter CBF exceeds the judgment value KBF. In step 230, the ON time correction coefficient KBFA is constantly set at a fixed value of 1.5.

In the routine shown in FIG. 26, on the other hand, step 260 is performed in the same situation as described above. In step 260, the ON time correction coefficient KBFA is set as appropriate in accordance with the count reached by the backfire counter CBF. More specifically, the ON time correction coefficient KBFA corresponding to the count reached by the backfire counter CBF is read in accordance with the map stored in the ECU 50.

As indicated within a box for step 260, the above-mentioned map is set so that the ON time correction coefficient KBFA approaches to a reference value of 1.0 when the value of the backfire counter CBF increases. According to the map, therefore, the ON time correction coefficient KBFA is sufficiently great immediately after the occurrence of backfire is recognized. Then, the ON time correction coefficient KBFA approaches to the value 1.0 as time elapses.

In other words, the routine shown in FIG. 26 ensures that the ON time VSVONT for the D-VSV 14 (N) is sufficiently longer than the reference ON time immediately after the occurrence of backfire is recognized, and subsequently approaches to the reference ON time as time elapses. The use of such a setup makes it possible to temporarily increase the amount of fuel supply to each cylinder after the occurrence of backfire, and then smoothly restore the reference fuel supply amount. After the occurrence of backfire, therefore, the apparatus according to the present embodiment provides higher internal combustion engine stability than the apparatus according to the eleventh embodiment, which has been described earlier.

Thirteenth Embodiment

Features of Thirteenth Embodiment

A thirteenth embodiment of the present invention will now be described with reference to FIGS. 27 and 28.

Figure 27:
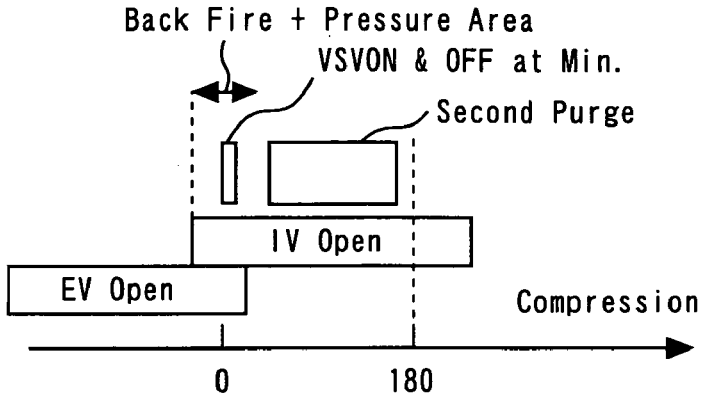
FIG. 27 is a timing diagram illustrating an operation that is particular to an evaporative fuel supply apparatus according to a thirteenth embodiment of the present invention.

FIG. 27 is a timing diagram illustrating an operation that is peculiar to the apparatus according to the present embodiment. More specifically, this timing diagram illustrates a purge pattern that is applied to a cylinder in which backfire is generated.

When the occurrence of backfire is recognized in a certain cylinder, the apparatus according to the present embodiment immediately stops a purge execution for the cylinder as is the case with the apparatus according to the eleventh or twelfth embodiment. More specifically, when the occurrence of backfire is recognized in a certain cylinder, the apparatus according to the present embodiment sets the minimum time KVSVMN as the ON time VSVONT for the D-VSV that relates to the cylinder.

The backfiring-induced abnormal pressure persists until the crank angle of a cylinder in which backfire is generated is several tens of degrees CA after intake top dead center after the intake valve for the cylinder opens. When the D-VSV opens for the minimum time KVSVMN, it is possible to prevent a large amount of evaporative fuel from flowing into the intake path 20 while the abnormal pressure is generated. As a result, it is possible to prevent backfire from being promoted by fresh fuel. Further, when the D-VSV opens for the minimum time KVSVMN, it is possible to appropriately release the abnormal pressure from the intake path 20 to the canister 10. Consequently, the intake path 20 can be protected without damaging the canister 10.

However, when the minimum time KVSVMN is set as the D-VSV valve opening time VSVONT during an intake stroke during which backfire is detected, a remarkably small amount of evaporative fuel is taken into a cylinder in which backfire is generated during the intake stroke. In this instance, a misfire inevitably occurs during the next explosion stroke to the detriment of internal combustion engine stability.

As such being the case, in a cylinder in which backfire is generated, the present embodiment opens the D-VSV for a short period of time, waits until the abnormal pressure vanishes, and performs the second fuel supply operation, as indicated in FIG. 27. When this process is performed, it is possible to supply an adequate amount of fuel to the cylinder in which backfire is generated, and avoid a misfire during the next explosion stroke of the cylinder.

Details of Process Performed by Thirteenth Embodiment

Figure 28:
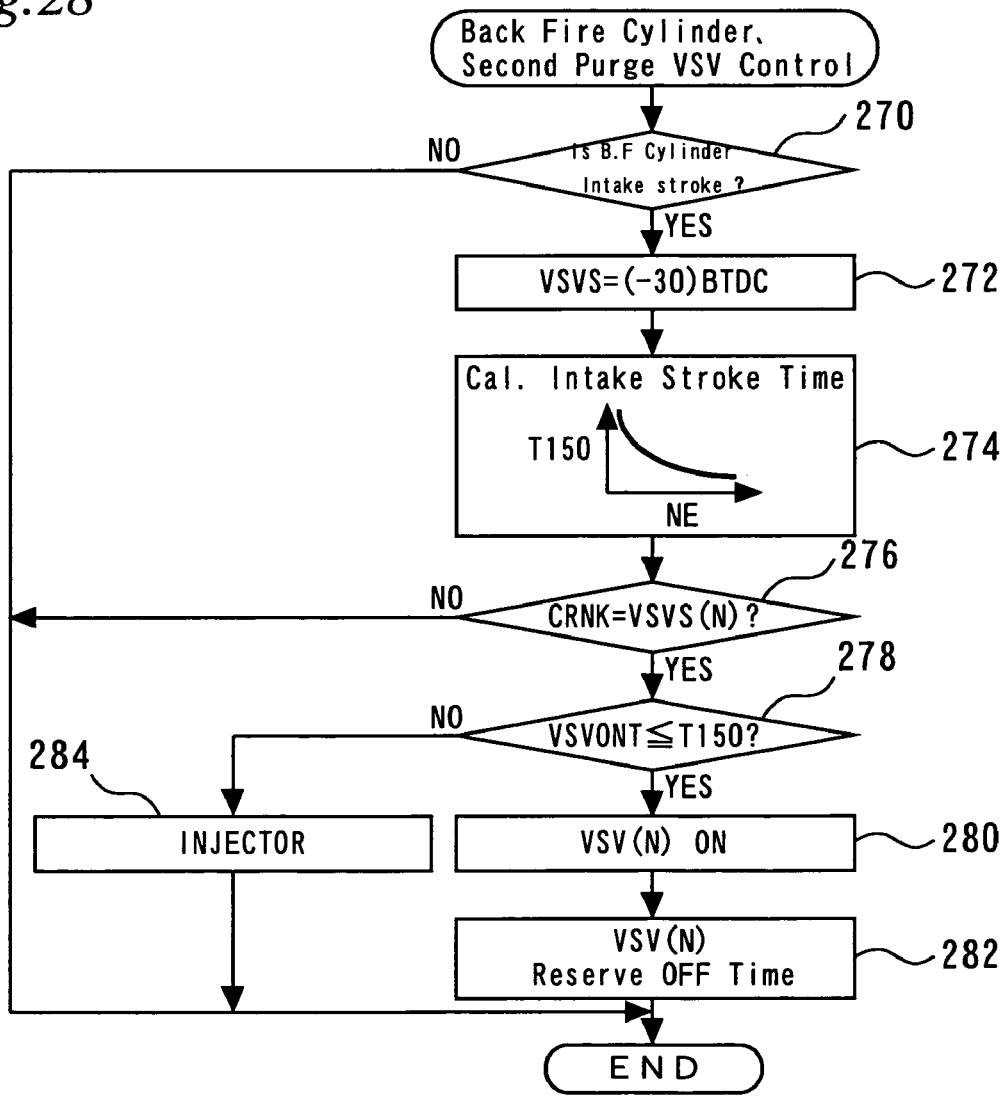
FIG. 28 is a flowchart illustrating a routine executed to perform the second fuel supply operation of a cylinder in which backfire is generated in the evaporative fuel supply apparatus according to the thirteenth embodiment of the present invention.

The apparatus according to the present embodiment is implemented when the ECU 50 in the apparatus according to the tenth embodiment (see FIGS. 20 to 23), in the apparatus according to the eleventh embodiment (see FIGS. 23 to 25), or in the apparatus according to the twelfth embodiment (see FIG. 26) additionally executes a routine shown in FIG. 28.

FIG. 28 is a flowchart illustrating a routine that the ECU 50 according to the present embodiment executes to perform the second fuel supply operation during the intake stroke of a cylinder in which backfire is generated. This routine is repeatedly executed at 4 msec or other sufficiently short intervals.

In the routine shown in FIG. 28, step 270 is first performed to judge whether the intake stroke is being performed in a cylinder in which backfire is generated. If the query in step 270 is answered "NO," the current process terminates immediately. If, on the other hand, the query in step 270 is answered "YES," the valve opening timing VSVS for the D-VSV (N) relating to the target cylinder is set at 30° CA after top dead center (BTDC −30° CA) (step 272).

When the valve opening timing VSVS is set at 30° CA after top dead center, the intake stroke of the target cylinder terminates when the crank angle is changed by 150° CA (the time required for this angular change is hereinafter referred to as the "intake stroke time T150") subsequently to the valve opening timing VSVS. In the routine shown in FIG. 28, step 274 is then performed to calculate the intake stroke time T150.

The intake stroke time T150 depends on the engine speed NE. The ECU 50 stores a map that defines the relationship between the intake stroke time T150 and engine speed NE. In step 274, the map is referenced to calculate the intake stroke time T150 for the current engine speed NE.

After the intake stroke time T150 is calculated, step 276 is performed to judge whether the current crank angle CRNK agrees with the valve opening timing VSVS (N), that is, equals to BTDC −30° CA. If the judgment result obtained in step 276 does not indicate that CRNK=VSVS (N), the current routine terminates immediately. If, on the other hand, the obtained judgment result indicates that CRNK=VSVS (N), step 278 is performed to judge whether the ON time VSVONT for the D-VSV 14 (N) is not longer than the intake stroke time T150.

As described above, step 278 is performed after the crank angle is 30° CA after top dead center. At this stage, the backfire flag XBF is reset to 0 because the abnormal pressure within the intake path 20 has vanished. Therefore, when the routine shown in FIG. 21, 24, or 26 is executed, the ON time VSVONT for the D-VSV 14 (N) is not set to the minimum time KVSVMN, but set to the time for supplying an adequate amount of fuel to each cylinder (see steps 196 and 218).

Step 278 is performed to judge whether the ON time VSVONT for supplying an adequate amount of fuel is not longer than the intake stroke time T150. In other words, step 278 is performed to judge whether the time interval between the time for opening the D-VSV 14 (N) and the end of the intake stroke of the target cylinder is adequate for performing a purge to supply an adequate amount of fuel.

If the obtained judgment result indicates that VSVONT≦T150, it is concluded that a proper amount of fuel can be replenished by performing an evaporative fuel purge. In this instance, step 280 is performed to turn ON the D-VSV 14 (N). After step 282 is performed to reserve the OFF time for the D-VSV 14 (N), the current processing cycle comes to an end.

If, on the other hand, the judgment result obtained in step 278 does not indicate that VSVONT≦T150, it is concluded that proper fuel replenishment cannot be achieved by performing an evaporative fuel purge. In this instance, fuel replenishment is achieved by the fuel injection valve 68 (N) without opening the D-VSV 14 (N) (step 284).

As described above, during the intake stroke of a cylinder in which backfire is generated, the routine shown in FIG. 28 supplies an adequate amount of fuel to the cylinder by performing the second purge or by injecting fuel with the fuel injection valve 68 (N) after the backfiring-induced abnormal pressure has vanished. Consequently, the apparatus according to the present embodiment provides improved internal combustion engine stability by avoiding, wherever possible, a misfire in a cylinder in which backfire is generated.

The thirteenth embodiment, which has been described above, assumes that the D-VSV 14 (N) is provided for each cylinder. However, the present invention is not limited to the use of such a configuration. Alternatively, the D-VSV may be shared by all cylinders as is the case with the third to eighth embodiments. When, in such an instance, the D-VSV opens/closes in synchronism with the intake stroke of each cylinder, it is possible to provide virtually the same advantage as the thirteenth embodiment, which has been described above.

Further, when the intake stroke time T150 for a cylinder in which backfire is generated is shorter than the ON time VSVONT for supplying a desired amount of fuel, the thirteenth embodiment, which has been described above, injects fuel with the fuel injection valve 68 (N). However, the present invention is not limited to the use of such a method. An alternative for use in such a situation is to give up adding fuel to the cylinder in which backfire is generated, and induce a perfect misfire in the next explosion stroke of the cylinder.

Fourteenth Embodiment

Features of Fourteenth Embodiment

A fourteenth embodiment of the present invention will now be described with reference to FIGS. 29 and 30.

Figure 29:
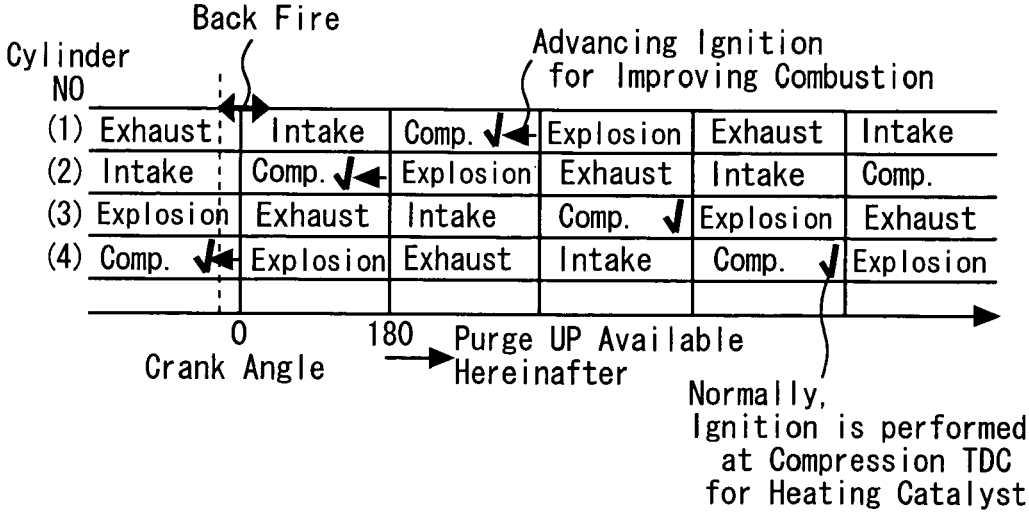
FIG. 29 is a timing diagram illustrating an operation that is particular to an evaporative fuel supply apparatus according to a fourteenth embodiment of the present invention.

FIG. 29 is a timing diagram illustrating an operation that is peculiar to the apparatus according to the present embodiment. More specifically, this timing diagram illustrates the ignition timing for each cylinder in a situation where backfire is generated in the first cylinder.

When backfire occurs in a certain cylinder, the apparatus according to the present embodiment increases the amount of fuel during a predetermined number of the post-backfiring intake strokes as is the case with the apparatus according to the eleventh embodiment (see FIGS. 23 to 25) and the apparatus according to the twelfth embodiment (see FIG. 26).

In an internal combustion engine (four-cylinder type) according to the present embodiment, the first cylinder, third cylinder, fourth cylinder, and second cylinder sequentially perform the intake stroke in order named, as indicated in FIG. 29. If, for instance, backfire occurs in the first cylinder, the first fuel increase operation is performed during the intake stroke of the third cylinder immediately after backfiring in the first cylinder. The cylinder for which the amount of fuel supply is increased can then avoid the occurrence of backfire almost perfectly.

The backfire in the first cylinder is detected near the intake top dead center of the first cylinder, that is, near the compression top dead center of the fourth cylinder. Therefore, if backfire occurs in the first cylinder, the explosion stroke begins in the fourth cylinder at almost the same time the backfire is detected. Subsequently, the explosion stroke of the second cylinder and the explosion stroke of the first cylinder sequentially start in order named each time the crank angle changes by approximately 180° CA. When an angular change of 180° CA subsequently occurs, the third cylinder, for which the amount of fuel supply is increased, initiates its explosion stroke.

When backfire occurs in the first cylinder, the apparatus according to the present embodiment performs the explosion stroke once each for the fourth, second, and first cylinders on condition that no fuel increase operation be performed before the explosion stroke in the third cylinder for which the amount of fuel supply is increased. These explosion strokes are performed while the amount of fuel supply is insufficient, that is, under conditions where backfire is likely to occur.

Backfire occurs when combustion in the explosion stroke is delayed so that the inside of a cylinder is maintained at a high temperature and at a high pressure until the exhaust stroke ends, that is, the intake stroke begins. Therefore, when the ignition timing is advanced so that the combustion in the cylinder begins earlier, backfire is not likely to occur.

When backfire in the first cylinder is detected, the ignition sequence in the fourth cylinder is normally ended. Therefore, as regards the explosion stroke for the fourth cylinder, which is performed when the amount of fuel supply is not increased, the combustion timing cannot be advanced by advancing the ignition timing. Meanwhile, the ignition sequences for the second and first cylinders, which are to be performed subsequently to the occurrence of backfire, can be advanced after the backfire is detected. In a situation where the explosion strokes for these cylinders are performed on condition that the amount of fuel supply be not increased, the apparatus according to the present embodiment advances the ignition timing.

Details of Process Performed by Fourteenth Embodiment

Figure 30:
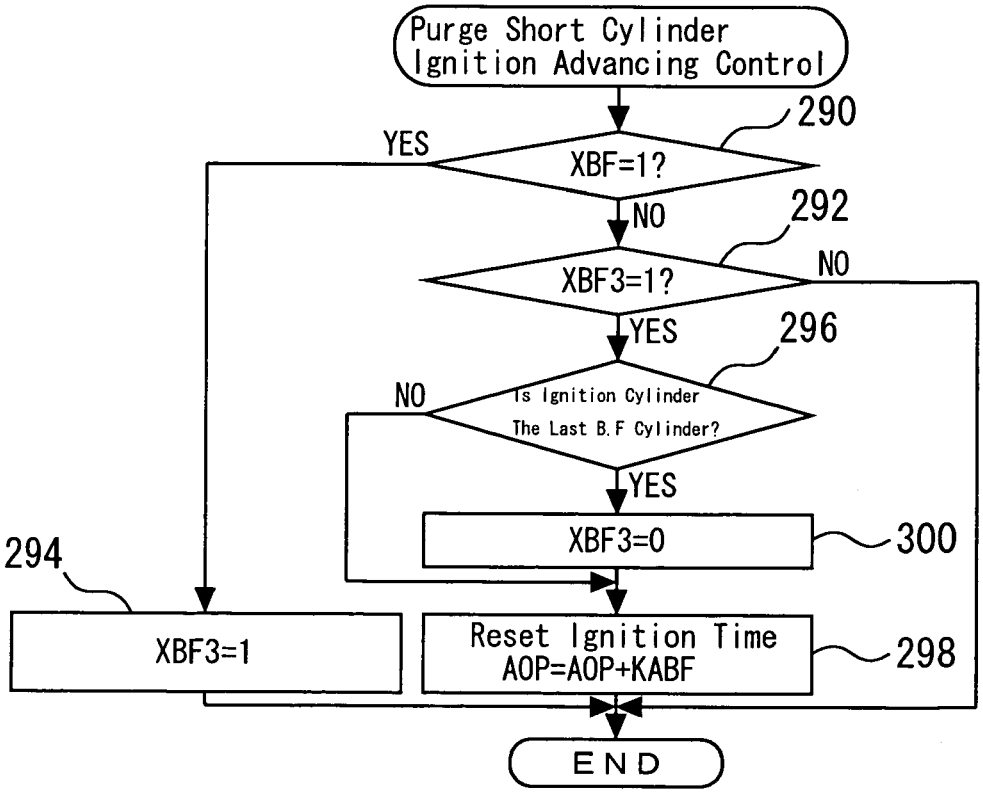
FIG. 30 is a flowchart illustrating a routine executed to advance the ignition timing after backfiring in the evaporative fuel supply apparatus according to the fourteenth embodiment of the present invention.

The apparatus according to the present embodiment is implemented when the ECU 50 in the apparatus according to the eleventh or twelfth embodiment additionally executes a routine shown in FIG. 30.

FIG. 30 is a flowchart illustrating a routine that the ECU 50 according to the present embodiment executes in order to control the ignition timing for each cylinder. This routine is repeatedly executed at 4 msec or other sufficiently short intervals.

In the routine shown in FIG. 30, step 290 is first performed to judge whether the backfire flag XBF is set to 1. While the occurrence of backfire is not recognized, the backfire flag XBF is set to 0. In such an instance, the query in step 290 is answered "NO."

If the query in step 290 is answered "NO," step 292 is performed to judge whether a third backfire flag XBF3 is set to 1. The third backfire flag XBF3 is initially set to 0. Therefore, while the occurrence of backfire is not recognized, the query in step 292 is answered "NO." In this instance, the current process terminates immediately.

The ECU 50 performs a process independently of the routine shown in FIG. 30 to set basic ignition timing AOP in accordance with the operation status of the internal combustion engine. When the routine shown in FIG. 30 terminates as described above, an ignition process is performed in each cylinder in accordance with the basic ignition timing AOP. Therefore, when the occurrence of backfire is not recognized, the apparatus according to the present embodiment performs an ignition process in all cylinders in accordance with the basic ignition timing AOP.

If backfire occurs in a certain cylinder, the backfire flag XBF is set to 1 when the intake valve for the cylinder opens. Consequently, the judgment result obtained in step 290, which is shown in FIG. 30, indicates that XBF=1. In this instance, the current processing cycle comes to an end after the third backfire flag XBF3 is set to 1 (step 294).

When the intake pressure PM lowers to a normal level within a cylinder in which backfire is generated, the backfire flag XBF is set to 0. When the backfire flag XBF reverts to 0, the judgment result subsequently obtained in step 290 does not indicate that XBF=1. Therefore, step 292 is performed again.

Since the third backfire flag XBF3 is set to 1 at the time of backfiring, the judgment result obtained this time indicates that XBF3=1. In this instance, step 296 is performed to judge whether the backfire cylinder is now an ignition cylinder.

In the example shown in FIG. 29, the step 296 condition is satisfied when the first cylinder becomes an ignition cylinder for the first time after backfire detection in the first cylinder. In other words, when the second cylinder becomes an ignition cylinder immediately after backfiring, it is judged that the step 296 condition is not satisfied.

If the step 296 condition is not satisfied, step 298 is performed to set the ignition timing again without changing the status of the third backfire flag XBF3. More specifically, step 298 is performed to advance the basic ignition timing AOP by a predetermined ignition timing correction amount KABF. After the above process is performed, the ECU 50 performs an ignition process for each cylinder with the advanced ignition timing.

When, in the example shown in FIG. 29, the first cylinder becomes an ignition cylinder after backfiring, the step 296 condition is satisfied. When the step 296 condition is satisfied, the third backfire flag XBF3 is set to 0 (step 300), and then an ignition timing advance process is performed (step 298). After the third backfire flag XBF3 is set to 0 as described above, the step 292 condition is not satisfied so that the ignition timing is not advanced.

As described above, the routine shown in FIG. 30 can advance the ignition timing for each cylinder by the predetermined ignition timing correction amount KABF during the time interval between the instant at which backfire occurs in a certain cylinder and the instant at which the first ignition takes place in the cylinder. After the first ignition occurs in a backfire cylinder, the ignition timing for each cylinder can be restored to the basic ignition timing AOP.

During the time interval between the instant at which backfire occurs in a certain cylinder and the instant at which the first ignition occurs in the cylinder, the explosion stroke is continuously performed on condition that the amount of fuel supply be not increased. During such an interval, the apparatus according to the present embodiment can advance the ignition timing to create a situation where backfire is not likely to occur. Consequently, the apparatus according to the present embodiment effectively prevents backfire from occurring again after the occurrence of backfire.

When backfire occurs in a certain cylinder and then the first ignition occurs in the cylinder, the explosion stroke can be performed for all cylinders on condition that the amount of fuel supply be increased. In such a situation, the ignition timing need not be advanced to avoid backfiring, and it is required that the basic ignition timing AOP be used to provide increased combustion efficiency. At this stage, the ignition timing reverts to the basic ignition timing AOP. Therefore, the apparatus according to the present embodiment satisfies the above requirement.

The fourteenth embodiment, which has been described above, is implemented when an ignition timing advance function is incorporated into the apparatus according to the eleventh or twelfth embodiment (the apparatus that is capable of increasing the fuel amount during the post-backfiring intake stroke). However, the present invention is not limited to the use of such a configuration. Alternatively, the ignition timing advance function may be incorporated into any apparatus according to the third to thirteenth embodiments.

Fifteenth Embodiment

Features of Fifteenth Embodiment

A fifteenth embodiment of the present invention will now be described with reference to FIGS. 31 to 33.

Figure 31:
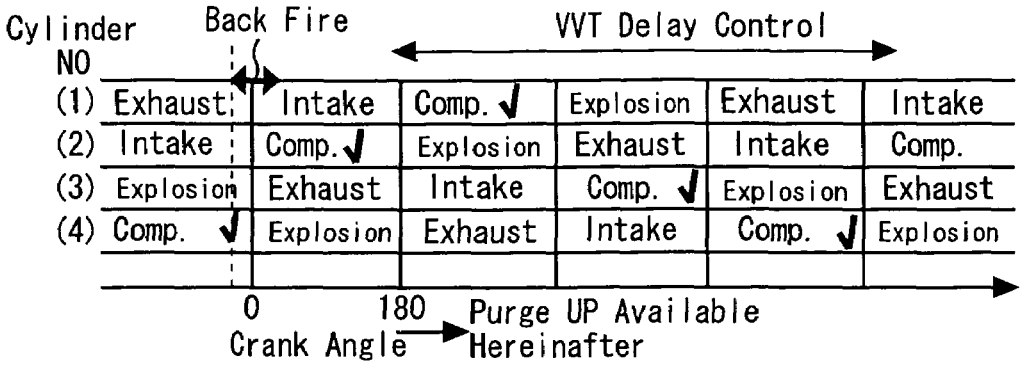
FIG. 31 is a timing diagram illustrating an operation that is particular to an evaporative fuel supply apparatus according to a fifteenth embodiment of the present invention.

FIG. 31 is a timing diagram illustrating an operation that is peculiar to the apparatus according to the present embodiment. More specifically, this timing diagram illustrates the valve timing for each cylinder that is set after backfiring in the first cylinder.

When the occurrence of backfire is recognized in a certain cylinder, the apparatus according to the present embodiment increases the amount of fuel during the post-backfiring intake stroke, which is performed later, as is the case with the apparatus according to the fourteenth embodiment. Further, as is the case with the fourteenth embodiment, the present embodiment repeats the explosion stroke without increasing the fuel amount, that is, while backfire is likely to occur, during the time interval between the instant at which backfire occurs in a certain cylinder and the instant at which the first explosion stroke terminates in the cylinder.

The apparatus according to the present embodiment includes a variable valve mechanism that provides variable valve opening timing for the intake valve. Therefore, the apparatus according to the present embodiment can vary the valve overlap period of the intake valve and exhaust valve by changing the valve opening timing for the intake valve.

Figure 32A:
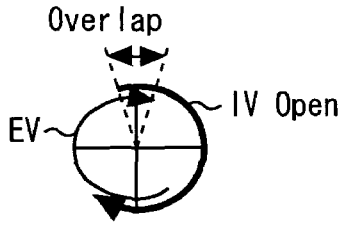
FIG. 32A illustrates the valve timing that is normally applied to the evaporative fuel supply apparatus according to the fifteenth embodiment of the present invention.
Figure 32B:
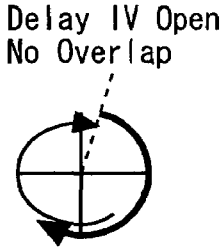
FIG. 32B illustrates the valve timing that is applied after the occurrence of backfire to the evaporative fuel supply apparatus according to the fifteenth embodiment of the present invention.

FIG. 32A illustrates the valve timing that is normally applied to the apparatus according to the present embodiment. FIG. 32B illustrates the valve timing that is applied to the apparatus according to the present embodiment after the occurrence of backfire.

When the normal timing shown in FIG. 32A is used, the intake valve opens while the exhaust valve is open. In other words, when the normal timing is used, an overlap period during which both valves are open arises. During the overlap period, the exhaust gas partly flows into the intake path 20. Therefore, if a high-temperature, high-pressure gas remains in a cylinder till the end of the exhaust stroke, backfire is likely to occur due to the existence of the overlap period.

When the retard timing shown in FIG. 32B is used, the exhaust valve closing timing is set after the top dead center, and the intake valve opening timing is retarded in order to avoid the occurrence of an overlap period. When this timing is employed, the gas in a cylinder is almost completely discharged into the exhaust path during the exhaust stroke. After the discharge of the exhaust gas is terminated, the intake path communicates with the interior of the cylinder. Therefore, when the retard timing shown in FIG. 32B is used, backfire is not likely to occur even if a high-temperature, high-pressure gas exists in a cylinder till the end of the exhaust stroke.

As such being the case, the present embodiment uses the retard timing, which is shown in FIG. 32B, during the time interval between the instant at which the occurrence of backfire is recognized and the instant at which the first explosion stroke is completed in a backfire cylinder (the generated exhaust gas is completely discharged by the explosion stroke). In the other situation, the present embodiment uses the normal timing, which is shown in FIG. 32A. The above process makes it possible to effectively prevent backfire from occurring frequently while the explosion stroke is repeated without increasing the amount of fuel immediately after the occurrence of backfire.

Details of Process Performed by Fifteenth Embodiment

Figure 33:
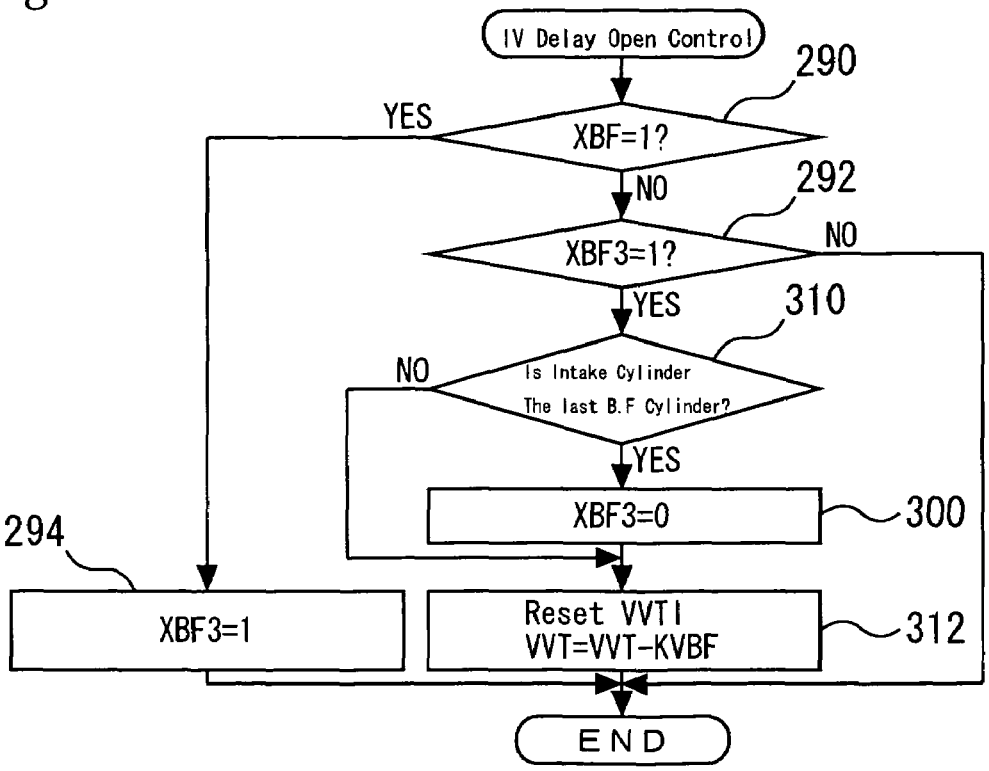
FIG. 33 is a flowchart illustrating a routine executed to retard the intake valve opening timing VVTI in the evaporative fuel supply apparatus according to the fifteenth embodiment of the present invention.

The apparatus according to the present embodiment is implemented when, for instance, the apparatus according to the fourteenth embodiment incorporates a variable valve mechanism for varying the intake valve opening timing and additionally executes a routine shown in FIG. 33. FIG. 33 is a flowchart illustrating a routine that the ECU 50 according to the present embodiment executes in order to calculate the intake valve opening timing VVTI for each cylinder. This routine is repeatedly executed at 4 msec or other sufficiently short intervals.

The routine shown in FIG. 33 is the same as the routine shown in FIG. 30 (see the fourteenth embodiment) except that step 296 is superseded by step 310 and that step 298 is superseded by step 310. Steps that are shown in FIG. 33 and identical with the steps shown in FIG. 30 are designated by the same reference numerals as their counterparts and omitted from the description or briefly described.

In other words, when the judgment result obtained in step 292 indicates that XBF3=1, the routine shown in FIG. 33 performs step 310 to judge whether the backfire cylinder is now an intake cylinder (a cylinder in which the intake stroke should begin).

While the query in step 310 is answered "NO," the status of the third backfire flag XBF3 is maintained, and the intake valve opening timing VVTI is retarded by a predetermined VVT correction amount KVBF from the basic timing VVT (step 310). When the query in step 310 is answered "YES," step 300 is performed to set the third backfire flag XBF3 to 0, and then step 310 is performed to retard the valve opening timing VVTI.

In the example shown in FIG. 31, the query in step 310 is answered "YES" or "NO" at a crank angle that is reached after backfire is detected in the first cylinder, the compression and explosion strokes are terminated in the first cylinder, and the exhaust stroke begins. In other words, the query in step 310 is answered "YES" or "NO" at a predetermined crank angle that is reached after the end of the last explosion stroke, which is performed without increasing the amount of fuel. When the query in step 310 is answered "YES," it is judged in the subsequent processing cycles that XBF3 is not equal to 1. Consequently, the intake valve opens with the basic valve opening timing VVT.

When backfire occurs in a certain cylinder, the process described above subsequently retards the intake valve opening timing VVTI until the last cylinder gas, for which the explosion stroke is performed without increasing the amount of fuel, is completely discharged. In the other situations, the process described above uses the basic valve opening timing VVT as the intake valve opening timing VVTI.

While the explosion stroke is performed without increasing the amount of fuel, a high-temperature, high-pressure gas may remain in a cylinder till the end of the exhaust stroke. In such a situation, the apparatus according to the present embodiment eliminates the valve overlap to create a situation where backfire is not likely to occur. Consequently, the apparatus according to the present embodiment effectively prevents backfire from occurring again immediately after the occurrence of backfire.

After the last cylinder gas, for which the explosion stroke is performed without increasing the amount of fuel, is discharged, it is conceivable that the cylinder gas invoking the occurrence of backfire does not remain in any cylinder till the end of the exhaust stroke. In such a situation, the intake valve opening timing need not be retarded in order to avoid the occurrence of backfire. It is required that the basic valve opening timing be used to provide increased combustion efficiency. Since the valve opening timing VVTI reverts to the basic timing at this stage, the apparatus according to the present embodiment satisfies the above requirement.

The fifteenth embodiment, which has been described above, is implemented when a function for retarding the intake valve opening timing VVTI is incorporated into the apparatus according to the fourteenth embodiment. However, the present invention is not limited to the use of such a configuration. Alternatively, a mechanism for retarding the intake valve opening timing VVTI may be incorporated into any apparatus according to the third to fourteenth embodiments.

Sixteenth Embodiment

Features of Sixteenth Embodiment

A sixteenth embodiment of the present invention will now be described with reference to FIGS. 34 and 35.

Figure 34:
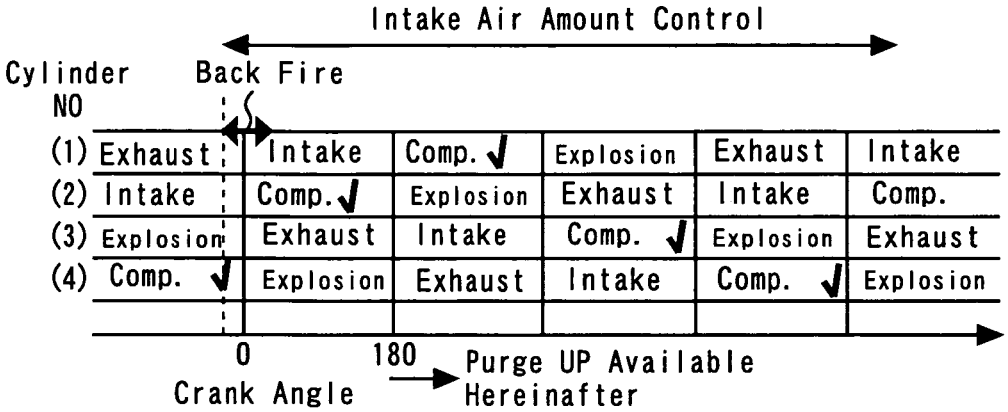
FIG. 34 is a timing diagram illustrating an operation that is particular to an evaporative fuel supply apparatus according to a sixteenth embodiment of the present invention.

FIG. 34 is a timing diagram illustrating an operation that is peculiar to the apparatus according to the present embodiment. More specifically, this timing diagram illustrates an intake air amount control operation that the present embodiment performs after backfiring in the first cylinder.

As indicated in FIG. 34, when the occurrence of backfire is recognized during the intake stroke of the first cylinder, the apparatus according to the present embodiment exercises "intake air amount control" for a predetermined period (e.g., until the intake stroke is performed again in the first cylinder). "Intake air amount control" is exercised to reduce the air amount for an internal combustion engine idling period QCAL by a predetermined air correction amount KQBF.

The apparatus according to the present embodiment uses an electronically-controlled throttle valve or ISCV (Idle Speed Control Valve) to control the air amount during an idling period QCAL. More specifically, while the above-mentioned intake air amount control is exercised, the throttle valve opening or ISCV opening for generating the idling period air amount QCAL is reduced from a reference value by a predetermined amount.

When the throttle valve opening or ISCV opening prevailing during an idling period is reduced, the intake pressure PM is rendered negative to a greater extent. The higher the extent to which the intake pressure PM is rendered negative, the larger the amount of evaporative fuel flow into the intake path 20 from the purge line 12. Therefore, when the above-mentioned intake air amount control is exercised, it is possible to increase the amount of evaporative fuel supply to each cylinder after the occurrence of backfire is recognized in a certain cylinder to prevent the recurrence of backfiring.

Details of Process Performed by Sixteenth Embodiment

Figure 35:
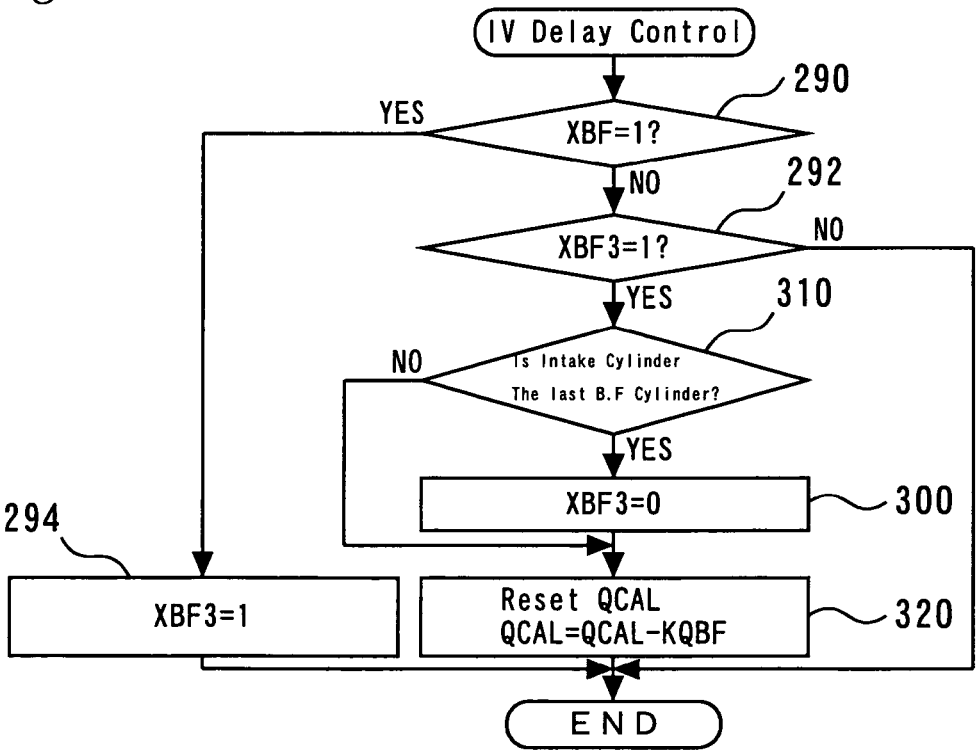
FIG. 35 is a flowchart illustrating a routine executed to control the idle air amount QCAL in the evaporative fuel supply apparatus according to the sixteenth embodiment of the present invention.

The apparatus according to the present embodiment is implemented when, for instance, the apparatus according to the fifteenth embodiment incorporates an electronic throttle valve or ISCV and additionally executes a routine shown in FIG. 35.

FIG. 35 is a flowchart illustrating a routine that the ECU 50 according to the present embodiment executes in order to control the idle air amount QCAL, or more specifically, control the intake pressure PM prevailing during an idling period. This routine is repeatedly executed at 4 msec or other sufficiently short intervals.

The routine shown in FIG. 35 is the same as the routine shown in FIG. 33 (see the fifteenth embodiment) except that step 312 is superseded by step 320. In other words, the routine shown in FIG. 35 can set the third backfire flag XBF3 to 1 immediately after the occurrence of backfire. Further, while the third backfire flag XBF3 is set to 1, the routine shown in FIG. 35 can reduce the basic idle air amount QCAL by the air correction amount KQBF. Therefore, the apparatus according to the present embodiment can render the intake pressure PM negative immediately after the occurrence of backfire to increase the amount of an evaporative fuel purge, thereby effectively preventing the recurrence of backfire.

The sixteenth embodiment, which has been described above, is implemented when a function for reducing the idle air amount QCAL is incorporated into the apparatus according to the fifteenth embodiment. However, the present invention is not limited to the use of such a configuration. Alternatively, the function for reducing the idle air amount QCAL may be incorporated into any apparatus according to the third to fifteenth embodiments.

Seventeenth Embodiment

Figure 36:
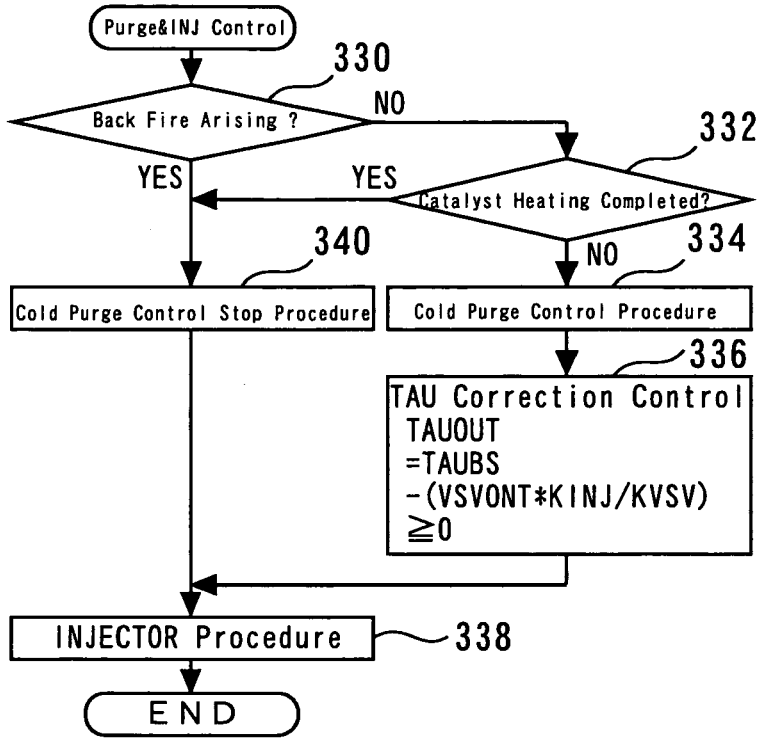
FIG. 36 is a flowchart illustrating a routine executed in order to properly select a fuel supply method for an internal combustion engine in an evaporative fuel supply apparatus according to a seventeenth embodiment of the present invention.

A seventeenth embodiment of the present invention will now be described with reference to FIG. 36. The apparatus according to the present embodiment is implemented when the apparatus according to one of the first to sixteenth embodiments executes a routine that is shown in FIG. 36. It is assumed, however, that the apparatus according to the present embodiment includes the fuel injection valve 68 (N) and ECU 50 no matter whether they are enumerated within the descriptions of the above-mentioned embodiments.

FIG. 36 is a flowchart illustrating a routine that the ECU 50 executes in order to properly select a fuel supply method for the internal combustion engine. The routine shown in FIG. 36 is started the moment the internal combustion engine starts up, and then repeatedly executed at intervals, for instance, of 4 msec.

In the routine shown in FIG. 36, step 330 is first performed to judge whether the occurrence of backfire is detected. More specifically, this step is performed to judge whether the occurrence of backfire is recognized by the method used in one of the third to eighth embodiments.

When the obtained judgment result indicates that no backfire has occurred, step 332 is performed to judge whether a catalyst warm-up operation is completed for the internal combustion engine. Whether the catalyst warm-up operation is completed can be determined in accordance, for instance, with the elapsed time after internal combustion engine startup or the cumulative intake air amount reached after internal combustion engine startup.

If it is found that the catalyst warm-up operation is still not completed, a cold purge control process is performed (step 334). The "cold purge control process" is performed to properly open the D-VSV 14 for the purpose of supplying a desired amount of evaporative fuel from the purge line 12 to the intake path 20. The control operation performed within the cold purge control process will not be described in detail because it is not an essential part of the present invention.

After the cold purge control process is terminated, step 336 is performed to exercise TAU correction control. The fuel requirements for internal combustion engine operation are not fully satisfied by the supply of evaporative fuel. TAU correction control is exercised so that the fuel injection valve 68 (N) injects the required additional amount of fuel. More specifically, the following equation is used in step 336 to calculate a fuel injection time command value TAUOUT, which is to be supplied to the fuel injection valve 68 (N):

$$TAUOUT=TAUBS-(VSVONT\times KINJ/KVSV)\geqq 0 \quad (3)$$

The value TAUBS denotes the injection time for causing the fuel injection valve 68 (N) to inject the entire amount of fuel required for the internal combustion engine, and is calculated by another main routine. The values KINJ and KVSV are coefficients that respectively represent the characteristics of the fuel injection valve 68 (N) and D-VSV 14. Physically, the value KINJ/KVSV is a conversion value for converting the ON time VSVONT of the D-VSV 14 to the ON time of the fuel injection valve 68 (N). Within Equation (3), "≧0" means that the value TAUOUT is guarded against decreasing below 0.

After the above process is terminated, the fuel injection valve 68 (N) is operated to perform a fuel injection process (step 338). If the value TAUOUT is calculated in accordance with Equation (3) due to the process performed in step 336, the value TAUOUT is given as a drive signal to the fuel injection valve for a cylinder in which the intake stroke is being performed. Consequently, the fuel injection valve 68 (N) injects the required additional amount of fuel to compensate for evaporative fuel insufficiency. As a result, the desired amount of fuel is supplied to the internal combustion engine.

When the catalyst warm-up operation ends without incurring backfire after internal combustion engine startup, it is found in step 332, which is mentioned earlier, that catalyst warm-up is completed. In this instance, step 340 is followed to perform a cold purge control interruption process. Step 338 is then followed to perform a fuel injection process. After step 340 is performed, the D-VSV 14 is kept closed. In this instance, the basic fuel injection time TAUBS, which is calculated by a main routine, is directly supplied to the fuel injection valve 68 (N) as the value TAUOUT. As a result, the entire fuel required for the internal combustion engine is supplied from the fuel injection valve 68 (N).

If backfire occurs during the time interval between internal combustion startup and catalyst warm-up termination, the occurrence of backfire is recognized in step 330. In this instance, step 340 is immediately performed to interrupt the cold purge control operation. If no backfire occurs during a catalyst warm-up operation, which is performed subsequently to internal combustion engine startup, the apparatus according to the present embodiment can supply fuel with priority given to evaporative fuel. After the occurrence of backfire, the apparatus according to the present embodiment can supply the entire fuel with the fuel injection valve 68 (N) only.

The amount of fuel can be regulated with higher accuracy when the fuel injection amount is controlled by adjusting the ON time of the fuel injection valve 68 (N) than when the amount of evaporative fuel is controlled by adjusting the opening of the D-VSV 14. Therefore, the apparatus according to the present embodiment can regulate the amount of fuel supply to the internal combustion engine with high accuracy after the occurrence of backfire than before the occurrence of backfire. When the accuracy increases, individual cylinders are not likely to suffer from fuel insufficiency, thereby making it possible to avoid the occurrence of backfire. Consequently, the apparatus according to the present embodiment effectively avoids successive occurrences of backfire after internal combustion engine cold startup.

Eighteenth Embodiment

Figure 37:
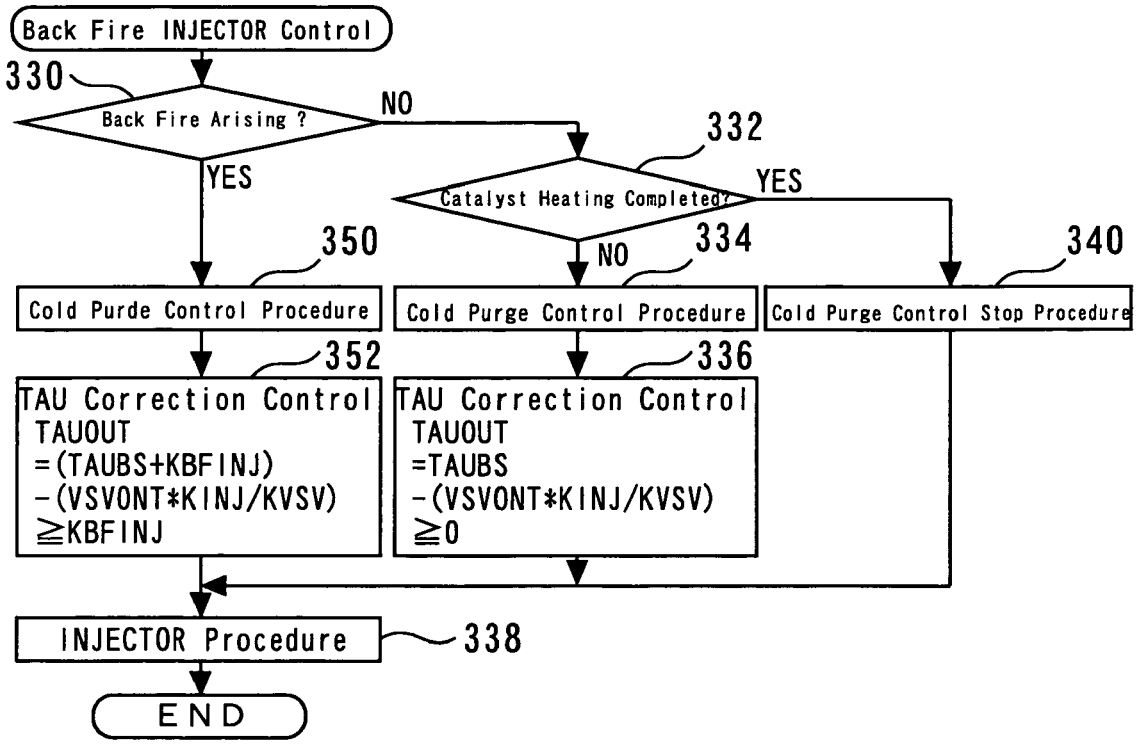
FIG. 37 is a flowchart illustrating a routine executed in order to properly select a fuel supply method for an internal combustion engine in an evaporative fuel supply apparatus according to a eighteenth embodiment of the present invention.

An eighteenth embodiment of the present invention will now be described with reference to FIG. 37. The apparatus according to the present embodiment is implemented when the apparatus according to one of the first to sixteenth embodiments executes a routine that is shown in FIG. 37. It is assumed, however, that the apparatus according to the present embodiment includes the fuel injection valve 68 (N) and ECU 50 no matter whether they are enumerated within the descriptions of the above-mentioned embodiments.

FIG. 37 is a flowchart illustrating a routine that the ECU 50 executes in order to properly select a fuel supply method for the internal combustion engine. The routine shown in FIG. 37 is started the moment the internal combustion engine starts up, and then repeatedly executed at intervals, for instance, of 4 msec.

The routine shown in FIG. 37 is the same as the routine shown in FIG. 36 except that steps 350 and 352 are performed instead of step 340 immediately after the occurrence of backfire is recognized. Steps that are shown in FIG. 37 and identical with the steps shown in FIG. 36 are designated by the same reference numerals as their counterparts and omitted from the description or briefly described.

In the routine shown in FIG. 37, a cold purge control process is performed (step 350) if the occurrence of backfire is recognized in step 330. The cold purge control process performed in this step is the same as the process performed in step 334. In other words, the routine shown in FIG. 37 constantly uses the same control method to continuously supply evaporative fuel to the internal combustion engine during the catalyst warm-up process no matter whether backfire is generated.

However, if the occurrence of backfire is recognized, increase amount TAU correction control is exercised (step 352), instead of normal TAU correction control (see step 334), after completion of step 350. Increase amount TAU correction control is exercised to ensure that the fuel injection time command value TAUOUT is greater than the normal TAUOUT value by an increase amount correction value KBFINJ, as indicated in the following equation:

$$TAUOUT=TAUBS+KBFINJ-(VSVONT\times KINJ/KVSV)\geqq KBFINJ \quad (4)$$

Within Equation (4) above, "≧KBFINJ" means that the value TAUOUT is guarded against decreasing below the increase amount correction value KBFINJ.

The above process ensures that the amount of fuel injection into each cylinder is larger after backfiring than before backfiring by an amount equivalent to the fuel injection time corresponding to the value KBFINJ. When the amount of fuel is increased in this manner, it is possible to effectively avoid successive occurrences of backfire while continuously supplying evaporative fuel. Consequently, the apparatus according to the present embodiment sufficiently improves the cold startability of the internal combustion engine.

Aspects of the present invention described above and the major benefits thereof are summarized as follows:

A first aspect of the present invention relates to an evaporative fuel supply apparatus. The apparatus includes a canister for storing evaporative fuel; a purge line for allowing the canister to communicate with an internal combustion engine intake path; a purge control valve installed in the purge line; and a pressure propagation suppression device for suppressing the pressure propagation from the intake path to the canister at the time of backfiring.

A second aspect of the present invention relates to the evaporative fuel supply apparatus according to the first aspect. In this apparatus, the pressure propagation suppression device includes a check valve that opens when the pressure exerted on the canister is higher than the pressure exerted on the intake path and closes when the pressure exerted on the intake path is higher than the pressure exerted on the canister.

A third aspect of the present invention relates to the evaporative fuel supply apparatus according to the second aspect. In this apparatus, the check valve is provided with an orifice for maintaining the communication between the intake path and the canister when the check valve is closed.

A fourth aspect of the present invention relates to the evaporative fuel supply apparatus according to the first aspect. This apparatus further includes a backfire detection device for detecting the occurrence of backfire. In this apparatus, the pressure propagation suppression device includes a purge inhibition device that closes the purge control valve when backfire is detected.

A fifth aspect of the present invention relates to the evaporative fuel supply apparatus according to the fourth aspect. This apparatus further includes a fuel injection valve for injecting fuel into each cylinder of the internal combustion engine; and a fuel injection valve control device for causing the fuel injection valve to inject the entire amount of fuel necessary for the internal combustion engine after backfire detection. In this apparatus, the purge inhibition device constantly keeps the purge control valve closed after backfire detection.

A sixth aspect of the present invention relates to the evaporative fuel supply apparatus according to the first aspect. This apparatus further includes a backfire detection device for detecting the occurrence of backfire. In this apparatus, the pressure propagation suppression device includes a changeover control valve, which changes the effective diameter of the purge line, and an effective diameter changeover device, which, when backfire is detected, controls the changeover control valve in such a manner as to decrease the effective diameter.

A seventh aspect of the present invention relates to the evaporative fuel supply apparatus according to the first aspect. This apparatus further includes a backfire detection device for detecting the occurrence of backfire. In this apparatus, the pressure propagation suppression device includes a valve opening reduction device, which reduces the opening of the purge control valve when backfire is detected.

An eighth aspect of the present invention relates to the evaporative fuel supply apparatus according to the fourth aspect. In this apparatus, the backfire detection device includes a combustion pressure sensor for detecting combustion pressure within a cylinder; and a backfire prediction device for predicting the occurrence of backfire on the basis of the combustion pressure prevailing before the beginning of fresh gas intake. In this apparatus, the pressure propagation suppression device performs a process for suppressing the pressure propagation when the occurrence of backfire is predicted.

A ninth aspect of the present invention relates to the evaporative fuel supply apparatus according to the first aspect. This apparatus further includes a backfire detection device for detecting the occurrence of backfire; and a fuel supply amount increase device for increasing the amount of fuel supply to the internal combustion engine during a post-backfiring intake stroke, which follows an intake stroke during which the backfire is generated.

A tenth aspect of the present invention relates to the evaporative fuel supply apparatus according to the ninth aspect. This apparatus further includes a control valve control device for opening the purge control valve during a predetermined valve opening period in synchronism with an intake stroke of each cylinder. In this apparatus, the fuel supply amount increase device includes a valve opening period increase device that makes the valve opening period, which corresponds to the post-backfiring intake stroke, longer than a reference valve opening period.

An eleventh aspect of the present invention relates to the evaporative fuel supply apparatus according to the tenth aspect. In this apparatus, the fuel supply amount increase device includes a valve opening timing advance device for ensuring that the purge control valve opening timing, which synchronizes with the post-backfiring intake stroke, occurs earlier than the reference valve opening timing.

A twelfth aspect of the present invention relates to the evaporative fuel supply apparatus according to the ninth aspect. This apparatus further includes a fuel injection valve for injecting fuel into each cylinder of the internal combustion engine. In this apparatus, the fuel supply amount increase device includes an injection valve control device for causing the fuel injection valve to inject a predetermined incremental correction amount of fuel into a cylinder in which the post-backfiring intake stroke is performed.

A thirteenth aspect of the present invention relates to the evaporative fuel supply apparatus according to the first aspect. This apparatus further includes a backfire detection device for detecting the occurrence of backfire; an abnormal pressure vanishment prediction device for estimating abnormal pressure vanishment in a cylinder in which backfire is generated; and a replenishment fuel supply device for supplying replenishment fuel to the cylinder, in which backfire is generated, after abnormal pressure vanishment estimation.

A fourteenth aspect of the present invention relates to the evaporative fuel supply apparatus according to the thirteenth aspect. This apparatus further includes a fuel injection valve for injecting fuel into each cylinder of the internal combustion engine. In this apparatus, the replenishment fuel supply device includes a purge replenishment judgment device for judging whether desired replenishment fuel can be supplied from the purge line during the time interval between the instant at which abnormal pressure vanishment in a cylinder in which backfire is generated is estimated and the instant at which the intake stroke is terminated in the cylinder; a purge replenishment execution device, which, when it is judged that the desired replenishment fuel can be supplied from the purge line, drives the purge control valve to supply the replenishment fuel; and an injection replenishment execution device, which, when it is judged that the desired replenishment fuel cannot be supplied from the purge line, causes the fuel injection valve to inject the replenishment fuel.

A fifteenth aspect of the present invention relates to the evaporative fuel supply apparatus according to the first aspect. This apparatus further includes a backfire detection device for detecting the occurrence of backfire; and an ignition timing advance device for advancing the ignition timing for each cylinder after the occurrence of backfire is detected.

A sixteenth aspect of the present invention relates to the evaporative fuel supply apparatus according to the first aspect. This apparatus further includes a variable valve timing mechanism for making intake valve opening timing adjustments; a backfire detection device for detecting the occurrence of backfire; and a valve opening timing change device for retarding the intake valve opening timing of each cylinder so that a valve overlap decreases after the occurrence of backfire is detected.

A seventeenth aspect of the present invention relates to the evaporative fuel supply apparatus according to the first aspect. This apparatus further includes an idle air amount adjustment mechanism that is positioned in the intake path of the internal combustion engine to vary the opening of the idle air amount adjustment mechanism until a desired intake air amount is obtained in an idle state; a backfire detection device for detecting the occurrence of backfire; and an idle air amount reduction device for reducing the opening of the idle air amount adjustment mechanism after the occurrence of backfire is detected. In this apparatus, the pressure propagation suppression device permits evaporative fuel to flow into the intake path via the purge line after abnormal pressure vanishment from a cylinder in which backfire is generated.

When backfire occurs, the first aspect of the present invention causes the pressure propagation suppression device to suppress the pressure propagation from the intake path to the canister. Thus, the invention effectively prevents the canister from being damaged by an abnormal pressure that is exerted when backfire occurs.

In the second aspect of the present invention, the check valve is normally open. Therefore, the evaporative fuel in the canister can be supplied to the intake path without invoking a great air flow resistance. Further, when backfire occurs, the check valve closes, thereby properly preventing an abnormal pressure from being exerted on the canister.

Even when the check valve is closed, the third aspect of the present invention allows the pressure on the intake path side to be released to the canister side via the orifice. Therefore, when backfire occurs, the invention avoids an undue increase in the pressure within the intake path.

When backfire occurs, the fourth aspect of the present invention closes the purge control valve, thereby properly preventing the pressure from propagating from the intake path side to the canister side.

After backfire occurs, the fifth aspect of the present invention can shut off the evaporative fuel supply and entirely supply a desired amount of fuel via the fuel injection valve. When fuel is supplied via the fuel injection valve, the fuel supply amount can be controlled with higher accuracy than when evaporative fuel is supplied. Consequently, the invention prevents successive occurrences of backfire.

When backfire occurs, the sixth aspect of the present invention can decrease the effective diameter of the purge line by changing the state of the changeover control valve. Thus, the invention properly controls the propagation of abnormal pressure, which is caused by the occurrence of backfire, without having to change the control operation of the purge control valve.

When backfire occurs, the seventh aspect of the present invention reduces the opening of the purge control valve to suppress the pressure propagation from the intake path side to the canister side while allowing the pressure on the intake path side to be properly released to the canister side. Thus, the invention sufficiently reduces the damage received by the canister and the damage received by the intake path when backfire occurs.

The eighth aspect of the present invention predicts the occurrence of backfire before the start of fresh gas intake, and performs a process for suppressing the pressure propagation. When the process for suppressing the pressure propagation is performed, it is possible to prevent fresh gas from entering the intake path. Thus, the invention can prevent the occurrence of backfire.

When backfire occurs in a certain cylinder and the post-backfiring intake stroke is subsequently performed in another cylinder, the ninth aspect of the present invention increases the amount of fuel supply to the internal combustion engine. When the amount of fuel supply increases, the cylinder combustion becomes stable to prevent the occurrence of backfire. Thus, the invention avoids successive occurrences of backfire.

The tenth aspect of the present invention increases the period of time during which the purge control valve is open for a cylinder in which the post-backfiring intake stroke is performed, thereby properly increasing the amount of fuel supply to the cylinder.

The eleventh aspect of the present invention advances the time at which the purge control valve opens for a cylinder in which the post-backfiring intake stroke is performed. In this instance, the period of time during which the purge control valve is open can be increased and terminated before the post-backfiring intake stroke is terminated. Thus, the invention properly increases the amount of fuel supply to a cylinder in which the post-backfiring intake stroke is performed.

The twelfth aspect of the present invention causes the fuel injection valve to inject an incremental correction amount of fuel into a cylinder in which the post-backfiring intake stroke is performed. Thus, the invention properly increases the amount of fuel supply after backfiring.

When backfire occurs in a cylinder, the thirteenth aspect of the present invention supplies replenishment fuel to the cylinder after an abnormal pressure vanishes. After the abnormal pressure has vanished, no backfire is invoked even when fuel is supplied. Further, this type of processing avoids a situation in which an insufficient amount of fuel is supplied to a cylinder in which backfire is generated. Thus, the invention makes it possible to restore a proper operation status immediately after the occurrence of backfire.

When an abnormal pressure vanishes from a cylinder in which backfire is generated, the fourteenth aspect of the present invention judges whether the fuel replenishment for the cylinder can be achieved by performing an evaporative fuel purge. If such replenishment is achievable, the fourteenth aspect of the present invention supplies evaporative fuel for replenishment purposes. If such replenishment is unachievable, the fourteenth aspect of the present invention uses the fuel injection valve for replenishment purposes. Thus, the invention gives priority to the supply of evaporative fuel wherever possible, and properly achieves fuel replenishment for a cylinder in which backfire is generated.

After the occurrence of backfire is detected, the fifteenth aspect of the present invention advances the ignition timing for each cylinder. When the ignition timing is advanced, the combustion state prevailing in a cylinder improves. Therefore, the subsequent occurrence of backfire can be suppressed.

After the occurrence of backfire is detected, the sixteenth aspect of the present invention retards the intake valve opening timing in such a manner as to decrease the valve overlap. When the valve overlap decreases, the gas in a cylinder can be readily discharged and is not likely to flow backward to the intake path. Consequently, backfire generation is not likely to occur. Thus, the invention makes it possible to effectively avoid successive occurrences of backfire.

After the occurrence of backfire is detected, the seventeenth aspect of the present invention reduces the opening of the idle air amount adjustment mechanism, thereby increasing the intake negative pressure. When the intake negative pressure increases, the amount of fuel taken into the intake path from the purge line increases. Thus, the invention can avoid successive occurrences of backfire by increasing the amount of fuel supply to each cylinder after the occurrence of backfire.

In the first embodiment, which has been described above, the D-VSV 14 corresponds to the "purge control valve" according to the first aspect of the present invention; and the check valve 16 corresponds to the "pressure propagation suppression device" according to the first aspect of the present invention.

In the third embodiment, which has been described above, the "backfire detection device" according to the fourth aspect of the present invention is implemented when the ECU 50 executes the routine shown in FIG. 7; and the "purge inhibition device" according to the fourth aspect of the present invention is implemented when the ECU 50 performs step 120.

In the fourth embodiment, which has been described above, the "backfire detection device" according to the fourth aspect of the present invention is implemented when the ECU 50 executes the routine shown in FIG. 10; and the "purge inhibition device" according to the fourth aspect of the present invention is implemented when the ECU 50 performs step 120, which is shown in FIG. 8.

In the fifth embodiment, which has been described above, the "backfire detection device" according to the fourth aspect of the present invention is implemented when the ECU 50 executes the routine shown in FIG. 12; and the "purge inhibition device" according to the fourth aspect of the present invention is implemented when the ECU 50 performs step 120, which is shown in FIG. 8.

In the sixth embodiment, which has been described above, the "backfire detection device" according to the fourth aspect of the present invention is implemented when the ECU 50 executes the routine shown in FIG. 14; and the "purge inhibition device" according to the fourth aspect of the present invention is implemented when the ECU 50 performs step 120, which is shown in FIG. 8.

In the seventh embodiment, which has been described above, the "backfire detection device" according to the fourth aspect of the present invention is implemented when the ECU 50 executes the routine shown in FIG. 16; and the "purge inhibition device" according to the fourth aspect of the present invention is implemented when the ECU 50 performs step 120, which is shown in FIG. 8.

In the eighth embodiment, which has been described above, the "backfire detection device" according to the fourth aspect of the present invention and the "backfire prediction device" according to the eighth aspect of the present invention are implemented when the ECU 50 executes the routine shown in FIG. 17; and the "purge inhibition device" according to the fourth aspect of the present invention is implemented when the ECU 50 performs step 120, which is shown in FIG. 8.

In the ninth embodiment, which has been described above, the "backfire detection device" according to the sixth aspect of the present invention is implemented when the ECU 50 performs steps 180 and 182; and the "effective diameter changeover device" according to the sixth aspect of the present invention is implemented when the ECU 50 performs step 186. Further, the flow rate changeover VSVs 66 (N) correspond to the "changeover control valve" according to the sixth aspect of the present invention.

In the tenth embodiment, which has been described above, the "backfire detection device" according to the seventh aspect of the present invention is implemented when the ECU 50 executes the routine shown in FIG. 12; and the "valve opening reduction device" according to the seventh aspect of the present invention is implemented when the ECU 50 performs step 198.

In the eleventh embodiment, which has been described above, the "backfire detection device" according to the ninth aspect of the present invention is implemented when the ECU 50 executes the routine shown in FIG. 12; and the "fuel supply amount increase device" according to the ninth aspect of the present invention is implemented when the ECU 50 performs steps 210, 212, and 226 to 230.

Further, in the eleventh embodiment, which has been described above, the "control valve control device" according to the tenth aspect of the present invention is implemented when the ECU 50 performs steps 240 to 250; and the "valve opening period increase device" according to the tenth aspect of the present invention is implemented when the ECU 50 performs step 230.

Furthermore, in the eleventh embodiment, which has been described above, the "valve opening timing advance device" according to the eleventh aspect of the present invention is implemented when the ECU 50 performs step 244.

In the twelfth embodiment, which has been described above, the "fuel supply amount increase device" according to the ninth aspect of the present invention is implemented when the ECU 50 performs steps 210, 212, 226, 228, and 260; and the "valve opening period increase device" according to the tenth aspect of the present invention is implemented when the ECU 50 performs step 230.

In the thirteenth embodiment, which has been described above, the "backfire detection device" according to the thirteenth aspect of the present invention is implemented when the ECU 50 executes the routine shown in FIG. 12; the "abnormal pressure vanishment prediction device" according to the thirteenth aspect of the present invention is implemented when the ECU 50 starts the second fuel replenishment operation after the crank angle CRNK is BTDC −30° CA, that is, performs steps 272 and 276; and the "replenishment fuel supply means" according to the thirteenth aspect of the present invention is implemented when the ECU 50 performs steps 280 to 284.

Further, in the thirteenth embodiment, which has been described above, the "purge replenishment judgment device" according to the fourteenth aspect of the present invention is implemented when the ECU 50 performs steps 274 and 278; the "purge replenishment execution device" according to the fourteenth aspect of the present invention is implemented when the ECU 50 performs steps 280 and 282; and the "injection replenishment execution device" according to the fourteenth aspect of the present invention is implemented when the ECU 50 performs step 284.

In the fourteenth embodiment, which has been described above, the "backfire detection device" according to the fifteenth aspect of the present invention is implemented when the ECU 50 executes the routine shown in FIG. 12; and the "ignition timing advance device" according to the fifteenth aspect of the present invention is implemented when the ECU 50 performs step 298.

In the fifteenth embodiment, which has been described above, the "backfire detection device" according to the sixteenth aspect of the present invention is implemented when the ECU 50 executes the routine shown in FIG. 12; and the "valve opening timing change device" according to the sixteenth aspect of the present invention is implemented when the ECU 50 performs step 312.

In the sixteenth embodiment, which has been described above, the electronic throttle valve or ISCV corresponds to the "idle air amount adjustment mechanism" according to the seventeenth aspect of the present invention; the "backfire detection device" according to the seventeenth aspect of the present invention is implemented when the ECU 50 executes the routine shown in FIG. 12; and the "idle air amount reduction device" according to the seventeenth aspect of the present invention is implemented when the ECU 50 performs step 320.

In the seventeenth embodiment, which has been described above, the "fuel injection valve control device" according to the fifth aspect of the present invention is implemented when the ECU 50 performs steps 340 and 338.

In the eighteenth embodiment, which has been described above, the "injection valve control device" according to the twelfth aspect of the present invention is implemented when the ECU 50 performs steps 352 and 338.

Further, the present invention is not limited to these embodiments, but variations and modifications may be made without departing from the scope of the present invention.

The invention claimed is:

1. An evaporative fuel supply apparatus comprising:

a canister for storing evaporative fuel;

a purge line for allowing the canister to communicate with an internal combustion engine intake path;

a purge control valve installed in the purge line;

a backfire detection device for detecting the occurrence of backfire; and a pressure propagation suppression device for suppressing the pressure propagation from the intake path to the canister when backfire is detected, wherein the pressure propagation suppression device includes a purge inhibition device that closes the purge control valve when backfire is detected.

2. The evaporative fuel supply apparatus according to claim 1, further comprising:

a fuel injection valve for injecting fuel into each cylinder of the internal combustion engine; and a fuel injection valve control device for causing the fuel injection valve to inject the entire amount of fuel necessary for the internal combustion engine after backfire detection;

wherein the purge inhibition device constantly keeps the purge control valve closed after backfire detection.

3. The evaporative fuel supply apparatus according to claim 1, wherein the backfire detection device includes a combustion pressure sensor for detecting combustion pressure within a cylinder; and a backfire prediction device for predicting the occurrence of backfire on the basis of the combustion pressure prevailing before the beginning of fresh gas intake; and wherein the pressure propagation suppression device performs a process for suppressing the pressure propagation when the occurrence of backfire is predicted.

4. The evaporative fuel supply apparatus according to claim 1, further comprising:

a fuel supply amount increase device for increasing the amount of fuel supply to the internal combustion engine during a post-backfiring intake stroke, which follows an intake stroke during which the backfire is generated.

5. The evaporative fuel supply apparatus according to claim 4, further comprising:

a control valve control device for opening the purge control valve during a predetermined valve opening period in synchronism with an intake stroke of each cylinder, wherein the fuel supply amount increase device includes a valve opening period increase device that makes the valve opening period, which corresponds to the post-backfiring intake stroke, longer than a reference valve opening period.

6. The evaporative fuel supply apparatus according to claim 5, wherein the fuel supply amount increase device includes a valve opening timing advance device for ensuring that the purge control valve opening timing, which synchronizes with the post-backfiring intake stroke, occurs earlier than the reference valve opening timing.

7. The evaporative fuel supply apparatus according to claim 4, further comprising:

a fuel injection valve for injecting fuel into each cylinder of the internal combustion engine, wherein the fuel supply amount increase device includes an injection valve control device for causing the fuel injection valve to inject a predetermined incremental correction amount of fuel into a cylinder in which the post-backfiring intake stroke is performed.

8. The evaporative fuel supply apparatus according to claim 1, further comprising:

an abnormal pressure vanishment prediction device for estimating abnormal pressure vanishment in a cylinder in which backfire is generated; and replenishment fuel supply means for supplying replenishment fuel to the cylinder, in which backfire is generated, after abnormal pressure vanishment estimation.

9. The evaporative fuel supply apparatus according to claim 8, further comprising:

a fuel injection valve for injecting fuel into each cylinder of the internal combustion engine, wherein the replenishment fuel supply means includes a purge replenishment judgment device for judging whether desired replenishment fuel can be supplied from the purge line during the time interval between the instant at which abnormal pressure vanishment in a cylinder in which backfire is generated is estimated and the instant at which the intake stroke is terminated in the cylinder; a purge replenishment execution device, which, when it is judged that the desired replenishment fuel can be supplied from the purge line, drives the purge control valve to supply the replenishment fuel; and an injection replenishment execution device, which, when it is judged that the desired replenishment fuel cannot be supplied from the purge line, causes the fuel injection valve to inject the replenishment fuel.

10. The evaporative fuel supply apparatus according to claim 1, further comprising:

an ignition timing advance device for advancing the ignition timing for each cylinder after the occurrence of backfire is detected.

11. The evaporative fuel supply apparatus according to claim 1, further comprising:

a variable valve timing mechanism for making intake valve opening timing adjustments; and a valve opening timing change device for retarding the intake valve opening timing of each cylinder so that a valve overlap decreases after the occurrence of backfire is detected.

12. The evaporative fuel supply apparatus according to claim 1, further comprising:

an idle air amount adjustment mechanism that is positioned in the intake path of the internal combustion engine to vary the opening of the idle air amount adjustment mechanism until a desired intake air amount is obtained in an idle state; and an idle air amount reduction device for reducing the opening of the idle air amount adjustment mechanism after the occurrence of backfire is detected;

wherein the pressure propagation suppression device permits evaporative fuel to flow into the intake path via the purge line after abnormal pressure vanishment from a cylinder in which backfire is generated.

* * * * *